US007320624B2

(12) United States Patent
Hashim et al.

(10) Patent No.: US 7,320,624 B2
(45) Date of Patent: Jan. 22, 2008

(54) COMMUNICATIONS JACKS WITH COMPENSATION FOR DIFFERENTIAL TO DIFFERENTIAL AND DIFFERENTIAL TO COMMON MODE CROSSTALK

(75) Inventors: Amid Hashim, Plano, TX (US); Robert Ray Goodrich, Indianapolis, IN (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/688,458

(22) Filed: Mar. 20, 2007

(65) Prior Publication Data

US 2007/0178772 A1 Aug. 2, 2007

Related U.S. Application Data

(63) Continuation-in-part of application No. 11/088,044, filed on Mar. 23, 2005, now Pat. No. 7,204,722.

(60) Provisional application No. 60/636,595, filed on Dec. 16, 2004.

(51) Int. Cl.
*H01R 24/00* (2006.01)

(52) U.S. Cl. ..... 439/676; 439/344; 439/941

(58) Field of Classification Search ..... 439/676, 439/344, 941, 76.1, 489
See application file for complete search history.

(56) References Cited

U.S. PATENT DOCUMENTS

| | | | |
|---|---|---|---|
| 5,186,647 | A | 2/1993 | Denkmann et al. |
| 5,299,956 | A | 4/1994 | Brownell et al. |
| 5,310,363 | A | 5/1994 | Brownell et al. |
| 5,326,284 | A | 7/1994 | Bohbot et al. |
| 5,328,390 | A | 7/1994 | Johnston et al. |
| 5,362,257 | A | 11/1994 | Neal et al. |
| 5,397,862 | A | 3/1995 | Bockelman et al. |
| 5,414,393 | A | 5/1995 | Rose et al. |
| 5,432,484 | A | 7/1995 | Klas et al. |

(Continued)

FOREIGN PATENT DOCUMENTS

| | | |
|---|---|---|
| EP | 0 525 703 B1 | 2/1993 |

(Continued)

OTHER PUBLICATIONS

Belden CDT Networking Data Sheet for the 10GX Module www.BeldenIBDN.com.

(Continued)

*Primary Examiner*—Hien Vu
(74) *Attorney, Agent, or Firm*—Myers Bigel Sibley & Sajovec

(57) ABSTRACT

A communications jack assembly includes: a jack frame having a plug aperture; a dielectric mounting substrate attached to the jack frame; and a plurality of conductors engaged with the mounting substrate, each of the conductors including a fixed end portion mounted with the mounting substrate and a free end portion extending into the plug aperture for electrical contact with a mating plug, each of the free end portions having substantially the same profile and being substantially transversely aligned in side-by-side relationship. A first pair of conductors is sandwiched inside a second pair of conductors. The second pair of conductors includes a crossover, the positioning of crossover being selected to provide differential to common mode crosstalk compensation.

20 Claims, 22 Drawing Sheets

U.S. PATENT DOCUMENTS

| | | | |
|---|---|---|---|
| 5,547,405 | A | 8/1996 | Pinney et al. |
| 5,571,035 | A | 11/1996 | Ferrill |
| 5,587,884 | A | 12/1996 | Raman |
| 5,618,185 | A | 4/1997 | Aekins |
| 5,779,503 | A | 7/1998 | Tremblay et al. |
| 5,911,602 | A | 6/1999 | Vaden |
| 5,915,989 | A | 6/1999 | Adriaenssens et al. |
| 5,921,818 | A | 7/1999 | Larsen et al. |
| 5,947,772 | A | 9/1999 | Arnett et al. |
| 5,961,354 | A | 10/1999 | Hashim |
| 5,967,853 | A | 10/1999 | Hashim |
| 5,971,813 | A | 10/1999 | Kunz et al. |
| 5,975,919 | A | 11/1999 | Arnett et al. |
| 5,989,071 | A | 11/1999 | Larsen et al. |
| 5,997,358 | A | 12/1999 | Adriaenssens et al. |
| 6,017,247 | A | 1/2000 | Gwiazdowski |
| 6,042,427 | A | 3/2000 | Adriaenssens et al. |
| 6,050,843 | A | 4/2000 | Adriaenssens et al. |
| 6,102,730 | A | 8/2000 | Kjeldahl et al. |
| 6,116,964 | A | 9/2000 | Goodrich et al. |
| 6,120,330 | A | 9/2000 | Gwiazdowski |
| 6,165,023 | A | 12/2000 | Troutman et al. |
| 6,170,154 | B1 | 1/2001 | Swarup |
| 6,186,834 | B1 | 2/2001 | Arnett et al. |
| 6,196,880 | B1 | 3/2001 | Goodrich et al. |
| 6,238,235 | B1 | 5/2001 | Shavit et al. |
| 6,270,358 | B1 | 8/2001 | Nozick |
| 6,270,381 | B1 | 8/2001 | Adriaenssens |
| 6,312,290 | B1 | 11/2001 | Belopolsky |
| 6,350,158 | B1 | 2/2002 | Arnett et al. |
| 6,353,540 | B1 | 3/2002 | Narizuka et al. |
| 6,356,162 | B1 | 3/2002 | Deflandre et al. |
| 6,364,694 | B1 | 4/2002 | Lien |
| 6,379,157 | B1 | 4/2002 | Curry et al. |
| 6,379,198 | B1 | 4/2002 | Arnett et al. |
| 6,407,542 | B1 | 6/2002 | Conte |
| 6,428,362 | B1 | 8/2002 | Phommachanh |
| 6,443,776 | B2 | 9/2002 | Reichle |
| 6,443,777 | B1 | 9/2002 | McCurdy et al. |
| 6,454,541 | B1 | 9/2002 | Ijiri et al. |
| 6,464,529 | B1 | 10/2002 | Jensen et al. |
| 6,520,807 | B2 | 2/2003 | Winings |
| 6,524,128 | B2 | 2/2003 | Marowsky et al. |
| 6,530,810 | B2 | 3/2003 | Goodrich |
| 6,558,204 | B1 | 5/2003 | Weatherly |
| 6,558,207 | B1 | 5/2003 | Pepe et al. |
| 6,561,838 | B1 | 5/2003 | Blichfeldt |
| 6,571,187 | B1 | 5/2003 | Conte |
| 6,592,395 | B2 | 7/2003 | Brown et al. |
| 6,647,357 | B1 | 11/2003 | Conte |
| 6,716,964 | B1 | 4/2004 | Chinnadurai |
| 6,764,348 | B2 | 7/2004 | Han et al. |
| 6,811,442 | B1 | 11/2004 | Lien et al. |
| 6,962,503 | B2 | 11/2005 | Aekins |
| 2001/0018287 | A1 | 8/2001 | Reichle |
| 2001/0021608 | A1 | 9/2001 | Barbolla et al. |
| 2001/0048592 | A1 | 12/2001 | Nimomiya |
| 2002/0088977 | A1 | 7/2002 | Mori et al. |
| 2003/0129880 | A1 | 7/2003 | Arnett et al. |
| 2004/0002267 | A1 | 1/2004 | Hatterscheid et al. |
| 2005/0254223 | A1 | 11/2005 | Hashim |
| 2006/0121788 | A1 | 6/2006 | Pharney |
| 2006/0121789 | A1 | 6/2006 | Hashim |
| 2006/0160428 | A1 | 7/2006 | Hashim |

FOREIGN PATENT DOCUMENTS

| | | |
|---|---|---|
| EP | 0 901 201 | 3/1999 |
| EP | 1 059 704 | 12/2000 |
| EP | 1 191 646 | 3/2002 |
| EP | 1 435 679 | 7/2004 |
| WO | WO 94/05092 | 3/1994 |
| WO | WO 99/53574 | 10/1999 |
| WO | WO 03-019734 | 3/2003 |
| WO | WO 03/090322 | 10/2003 |

OTHER PUBLICATIONS

International Search Report and Written Opinion of the International Searching Authority for International Patent Application No. PCT/US2005/037162 mailed on Mar. 7, 2006.

COMMUNICATIONS JACKS WITH COMPENSATION FOR DIFFERENTIAL TO DIFFERENTIAL AND DIFFERENTIAL TO COMMON MODE CROSSTALK

CLAIM OF PRIORITY

This application claims priority as a continuation-in-part application to U.S. patent application Ser. No. 11/088,044, filed Mar. 23, 2005 now U.S. Pat. No. 7,204,722, which in turn claims priority from U.S. Provisional Patent Application Ser. No. 60/636,595, filed Dec. 16, 2004, the disclosures of both of which are hereby incorporated herein in their entirety.

FIELD OF THE INVENTION

The present invention relates generally to communication connectors and more particularly to crosstalk compensation in communication connectors.

BACKGROUND OF THE INVENTION

In an electrical communication system, it is sometimes advantageous to transmit information signals (video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs and radio stations to name but a few. Because this type of noise is common to both wires within a pair, the differential signal is typically not disturbed. This is a fundamental reason for having closely spaced differential pairs.

Of greater concern, however, is the electrical noise that is picked up from nearby wires or pairs of wires that may extend in the same general direction for some distances and not cancel differentially on the victim pair. This is referred to as crosstalk. Particularly, in a communication system involving networked computers, channels are formed by cascading plugs, jacks and cable segments. In such channels, a modular plug often mates with a modular jack, and the proximities and routings of the electrical wires (conductors) and contacting structures within the jack and/or plug also can produce capacitive as well as inductive couplings that generate near-end crosstalk (NEXT) (i.e., the crosstalk measured at an input location corresponding to a source at the same location) as well as far-end crosstalk (FEXT) (i.e., the crosstalk measured at the output location corresponding to a source at the input location). Such crosstalks occur from closely-positioned wires over a short distance. In all of the above situations, undesirable signals are present on the electrical conductors that can interfere with the information signal. When the same noise signal is added to each wire in the wire-pair, the voltage difference between the wires will remain about the same and differential cross-talk is not induced, while at the same time the average voltage on the two wires with respect to ground reference is elevated and common mode crosstalk is induced. On the other hand, when an opposite but equal noise signal is added to each wire in the wire pair, the voltage difference between the wires will be elevated and differential crosstalk is induced, while the average voltage on the two wires with respect to ground reference is not elevated and common mode crosstalk is not induced.

U.S. Pat. No. 5,997,358 to Adriaenssens et al. (hereinafter "the '358 patent") describes a two-stage scheme for compensating differential to differential NEXT for a plug-jack combination (the entire contents of the '358 patent are hereby incorporated herein by reference, as are U.S. Pat. Nos. 5,915,989; 6,042,427; 6,050,843; and 6,270,381). Connectors described in the '358 patent can reduce the internal NEXT (original crosstalk) between the electrical wire pairs of a modular plug by adding a fabricated or artificial crosstalk, usually in the jack, at one or more stages, thereby canceling or reducing the overall crosstalk for the plug-jack combination. The fabricated crosstalk is referred to herein as a compensation crosstalk. This idea can often be implemented by twice crossing the path of one of the differential pairs within the connector relative to the path of another differential pair within the connector, thereby providing two stages of NEXT compensation. This scheme can be more efficient at reducing the NEXT than a scheme in which the compensation is added at a single stage, especially when the second and subsequent stages of compensation include a time delay that is selected to account for differences in phase between the offending and compensating crosstalk. This type of arrangement can include capacitive and/or inductive elements that introduce multi-stage crosstalk compensation, and is typically employed in jack lead frames and printed wiring board ("PWB") strictures within jacks. These configurations can allow connectors to meet, for example, "Category 6" performance standards set forth in ANSI/EIA/TIA 568, which are primary component standards for mated plugs and jacks for transmission frequencies up to 250 MHz.

Alien NEXT is the differential crosstalk that occurs between communication channels. Obviously, physical separation between jacks will help and/or typical crosstalk approaches may be employed. However, a problem case may be "pair 3" of one channel crosstalking to "pair 3" of another channel, even if the pair 3 plug and jack wires in each channel are remote from each other and the only coupling occurs between the routed cabling. To reduce this form of alien NEXT, shielded systems containing shielded twisted pairs or foiled twisted pair configurations may be used. However, the inclusion of shields can increase cost of the system. Another approach to reduce or minimize alien NEXT utilizes spatial separation of cables within a channel and/or spatial separation between the jacks in a channel. However, this is typically impractical because bundling of cables and patch cords is common practice due to "real estate" constraints and ease of wire management.

In spite of recent strides made in improving mated connector (i.e., plug jack) performance, and in particular reducing crosstalk at elevated frequencies (e.g., 500 MHz—see U.S. patent application Ser. No. 10/845,104, entitled NEXT High Frequency Improvement by Using Frequency Dependent Effective Capacitance, filed May 4, 2004, the disclosure of which is hereby incorporated herein by reference), channels utilizing connectors that rely on either these teachings or those of the '358 patent can still exhibit unacceptably high alien NEXT, particularly at very high frequencies (e.g., 500 MHz).

SUMMARY OF THE INVENTION

The present invention can provide communications jacks with improved differential to common mode and differential to differential NEXT and FEXT performance, particularly at high frequencies. As a first aspect, embodiments of the present invention are directed to a wiring board for a communications jack, comprising: a dielectric mounting substrate; and a plurality of contact wires mounted in the mounting substrate, each of the contact wires including a fixed end portion mounted in the mounting substrate and a free end portion, each of the free end portions having substantially the same profile and being substantially transversely aligned in side-by-side relationship. A first pair of contact wires is sandwiched inside a second pair of contact wires. The second pair of contact wires includes a crossover, the positioning of crossover being selected to provide differential to common mode crosstalk compensation.

As a second aspect, embodiments of the present invention are directed to a wiring board for a communications jack, comprising: a dielectric mounting substrate; and first, second, third and fourth pairs of contact wires mounted in the mounting substrate, each of the contact wires including a fixed end portion mounted in the mounting substrate and a free end portion, each of the free end portions having substantially the same profile and being substantially transversely aligned in side-by-side relationship. The wires of the first pair of contact wires are immediately adjacent to each other and are sandwiched inside the third pair of contact wires, the wires of the second pair are immediately adjacent to each other, the wires of the fourth pair are immediately adjacent to each other, and the second and fourth pairs sandwich the third pair. The third pair of contact wires includes a crossover, the positioning of crossover being selected to provide differential to common mode crosstalk compensation.

As a third aspect, embodiments of the present invention are directed to a communications jack assembly, comprising: a jack frame having a plug aperture; a dielectric mounting substrate attached to the jack frame; and a plurality of conductors engaged with the mounting substrate, each of the conductors including a fixed end portion mounted with the mounting substrate and a free end portion extending into the plug aperture for electrical contact with a mating plug, each of the free end portions having substantially the same profile and being substantially transversely aligned in side-by-side relationship. A first pair of conductors is sandwiched inside a second pair of conductors. The second pair of conductors includes a crossover, the positioning of crossover being selected to provide differential to common mode crosstalk compensation.

Pursuant to further embodiments of the present invention, communications jacks are provided which include a housing having a plug aperture and a wiring board. These jacks further include a first contact wire and a second contact wire that form a first differential pair of contact wires, the first and second contact wires each having a fixed end portion that is mounted in the wiring board and a deflectable portion that is at least partially positioned in the plug aperture. These jacks also include a third contact wire and a fourth contact wire that form a second differential pair of contact wires, the third and fourth contact wires each having a fixed end portion that is mounted in the wiring board and a deflectable portion that is at least partially positioned in the plug aperture. In these jacks, at least a portion of the first differential pair of contact wires is sandwiched in between the contact wires of the second differential pair of contact wires, and the third contact wire crosses over the deflectable portion of the first contact wire and the deflectable portion of the second contact wire.

In some embodiments of these jacks the fourth contact wire may cross under the deflectable portion of the first contact wire and the deflectable portion of the second contact wire. Moreover, the fourth contact wire may also cross under the deflectable portion of the third contact wire and the third contact wire may also cross over the deflectable portion of the fourth contact wire. The portion of the third contact wire that crosses over the deflectable portions of the first and second contact wires may be a crossover segment, and the third contact wire may include a support finger. The crossover segment may be between the fixed end portion of the third contact wire and the support finger. The support finger may be supported by a separate support stricture.

In further embodiments of the present invention, communications jacks are provided which again include a housing having a plug aperture and a wiring board. The jacks also include a first contact wire and a second contact wire that form a first differential pair of contact wires, the first and second contact wires each comprising a wire segment that includes a fixed end mounted in the wiring board and a free end, as well as a third contact wire and a fourth contact wire that form a second differential pair of contact wires. The third and fourth contact wires, however, may each comprise a wire segment that includes a fixed end mounted in the wiring board and a free end, and a support finger that branches off of the wire segment between the fixed end and the free end.

In these jacks, the second differential pair of contact wires may include a crossover that is located in a deflectable portion of the contact wires. Moreover, the support finger of the third contact wire may engage a first support structure and the support finger of the fourth contact wire may engage a second support structure. These jacks may also include a stop that engages a distal end portion of the support finger of the third contact wire.

Pursuant to still further embodiments of the present invention, communications jacks are provided which include a housing having a plug aperture, a wiring board, a first contact wire and a second contact wire that form a first differential pair of contact wires, the first and second contact wires each having a fixed end portion that is mounted in the wiring board and a free end portion and a third contact wire and a fourth contact wire that form a second differential pair of contact wires, the third and fourth contact wires each having a fixed end portion that is mounted in the wiring board, a free end portion, an intermediate segment connecting the fixed end portion and the free end portion and a support finger branching off of the intermediate segment, the support finger including a base end that connects to the intermediate segment and a distal end opposite the base end. In these jacks, the support finger and the free end portion of the third contact wire may be substantially aligned in a longitudinal direction and may not be aligned with the fixed end portion of the third contact wire.

In these jacks, the third contact wire may be configured so that the support finger and the free end portion of the third contact wire form a beam that absorbs substantially all of the strain experienced by the third contact wire in response to insertion of a mating plug into the plug aperture. In addition, the distal end of the support finger of the third contact wire may not be fixedly mounted. These jacks may also include a first stop that engages the distal end of the support finger of the third contact wire and/or a second stop that engages the free end of the third contact wire when a mating plug is inserted into the plug aperture and then removed.

Pursuant to still further embodiments of the present invention, communications jacks are provided that include a housing having a plug aperture. These jacks further include a first contact wire and a second contact wire that form a first differential pair of contact wires, as well as a third contact wire and a fourth contact wire that form a second differential pair of contact wires. The first and second contact wires each including a first end, a second end and an intermediate portion connecting the first end and the second end. In addition, the jacks include a first conductive element branching off of the intermediate portion of the first contact wire. This first conductive element crosses over the third contact wire and the fourth contact wire. The jacks also include a second conductive element branching off of the intermediate portion of the second contact wire. The second conductive element similarly crosses under the third contact wire and the fourth contact wire.

In these jacks, the first ends and the second ends of the first and second contact wires may be free-floating. The jacks may also include a wiring board. The first conductive element may comprise a signal carrying path from the first contact wire onto the wiring board, and the second conductive element may comprise a signal carrying path from the second contact wire onto the wiring board. The jacks may further include a first stop that engages the first end of the first contact wire, a second stop that engages the first end of the second contact wire, a third stop that engages the second end of the first contact wire and/or a fourth stop that engages the second end of the second contact wire. In some embodiments of these jacks, the first conductive element may be a fixed end portion of the first contact wire, the first end of the first contact wire may be a distal end of a support finger of the first contact, the second conductive element may be a fixed end portion of the second contact wire, and/or the first end of the second contact wire may be a distal end of a support finger of the second contact.

DETAILED DESCRIPTION

Figure 1:
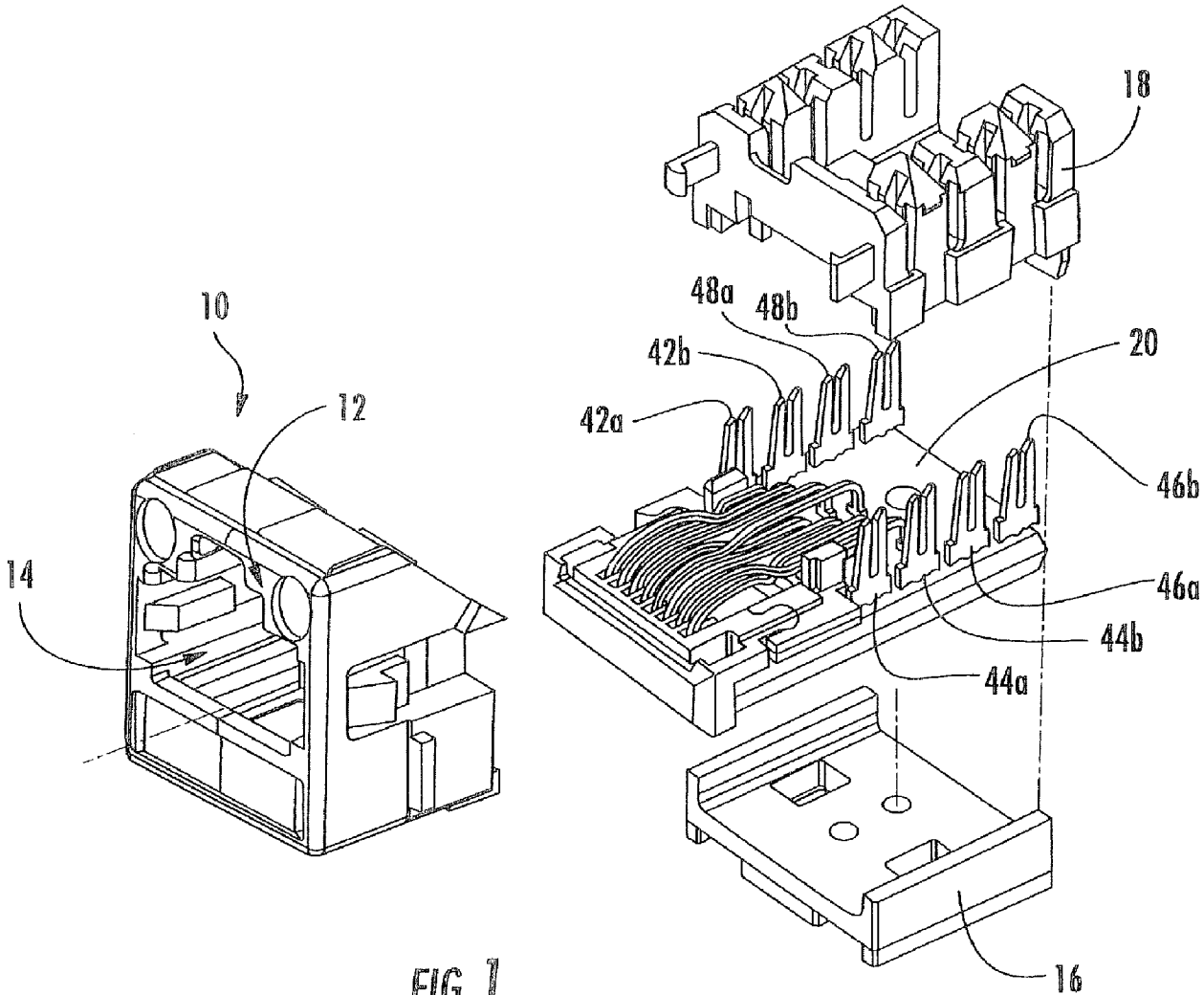
FIG. 1 (PRIOR ART)
FIG. 1 is an exploded perspective view of a prior art communications jack.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

This invention is directed to communications connectors, with a primary example of such being a communications jack. As used herein, the terms "forward", "forwardly", and "front" and derivatives thereof refer to the direction defined by a vector extending from the center of the jack toward the plug opening of the jack. Conversely, the terms "rearward", "rearwardly", and derivatives thereof refer to the direction directly opposite the forward direction; the rearward direction is defined by a vector that extends away from the plug opening toward the remainder of the jack. The terms "lateral," "laterally", and derivatives thereof refer to the direction generally parallel with the plane defined by a wiring board on which jack contact wires are mounted and extending away from a plane bisecting the plug in the center. The terms "medial," "inward," "inboard," and derivatives thereof refer to the direction that is the converse of the lateral direction, i.e., the direction parallel with the plane defined by the wiring board and extending from the periphery of the jack toward the aforementioned bisecting plane. Where used, the terms "attached", "connected", "interconnected", "contacting", "mounted" and the like can mean either direct or indirect attachment or contact between elements, unless stated otherwise. Where used, the terms "coupled," "induced" and the like can mean non-conductive interaction, either direct or indirect, between elements or between different sections of the same element, unless stated otherwise.

Figure 1A:
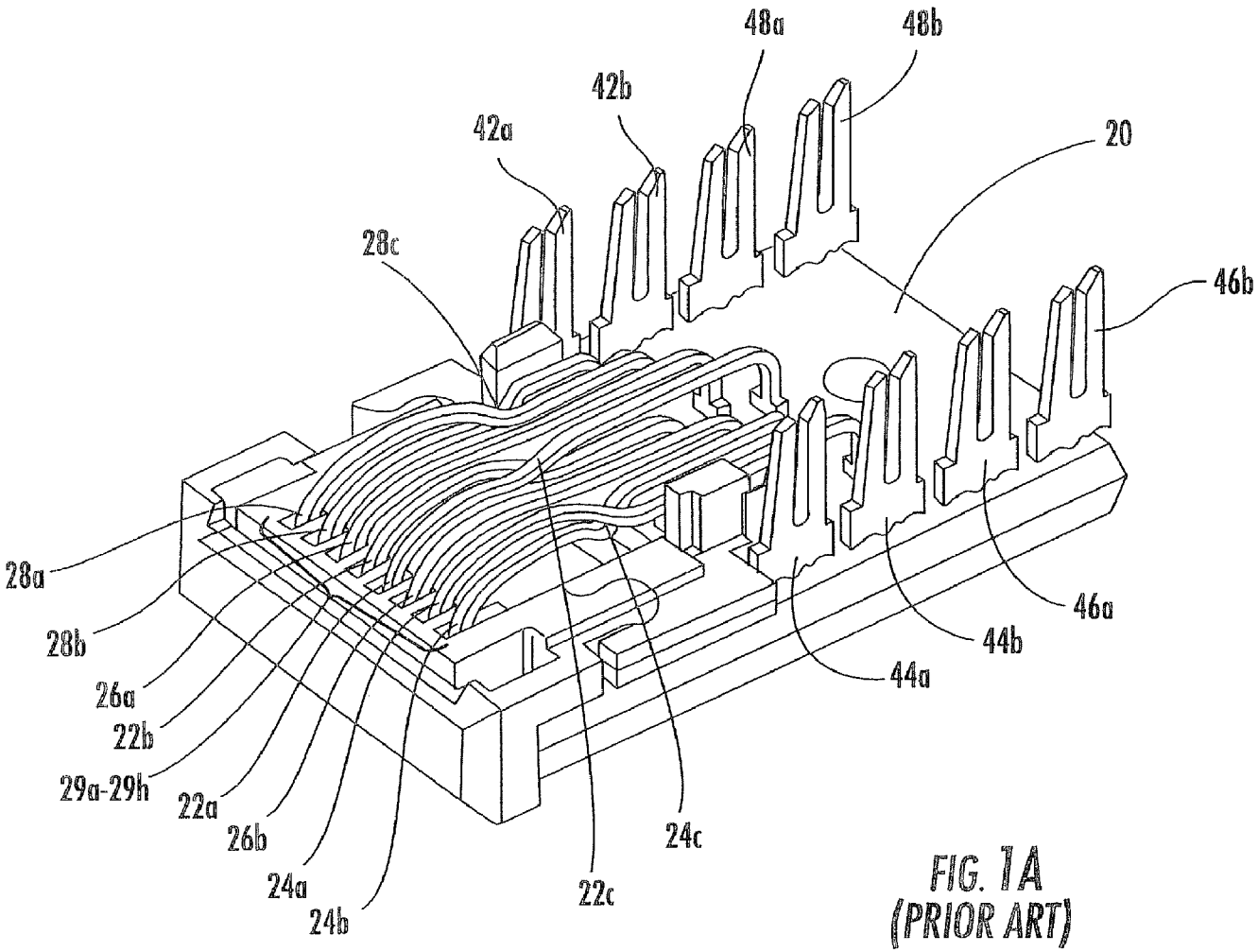
FIG. 1A (PRIOR ART)
FIG. 1A is an enlarged perspective view of the prior art communications jack of FIG. 1.

Referring now to the figures, a prior art jack, designated broadly at 10, is illustrated in FIGS. 1 and 1A. The jack 10 includes a jack frame 12 having a plug aperture 14 for receiving a mating plug, a cover 16 and a terminal housing 18. These components are conventionally formed and not need be described in detail herein; for a further description of these components and the manner in which they interconnect, see U.S. Pat. No. 6,350,158 to Arnett et al., the disclosure of which is hereby incorporated herein in its entirety. Those skilled in this art will recognize that other configurations of jack frames, covers and terminal housings may also be employed with the present invention. Exemplary configurations are illustrated in U.S. Pat. Nos. 5,975,919 and 5,947,772 to Arnett et al. and U.S. Pat. No. 6,454,541 to Hashim et al., the disclosure of each of which is hereby incorporated herein in its entirety.

Figure 2:
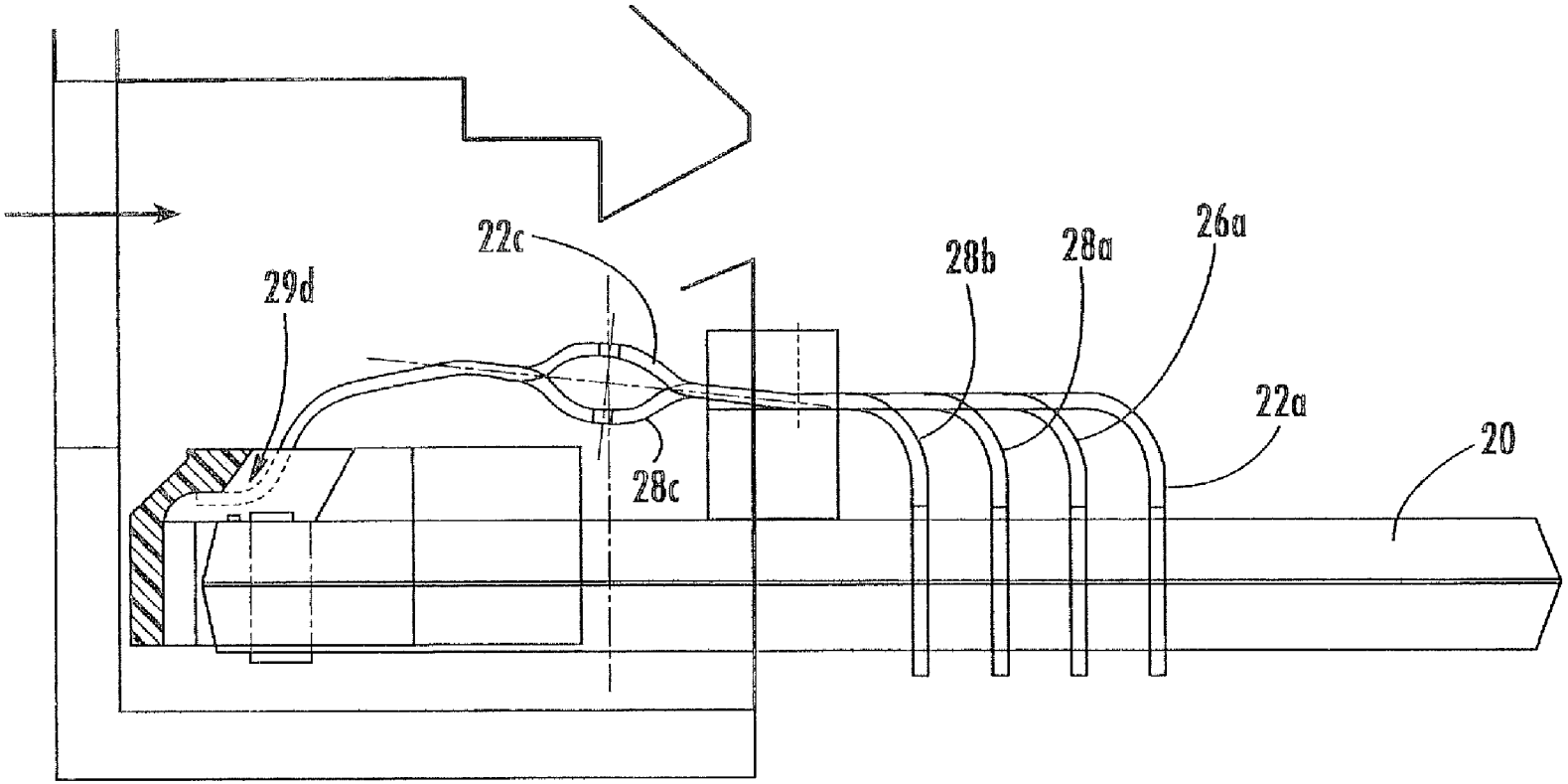
FIG. 2 (PRIOR ART)
FIG. 2 is a side view of contact wires of the jack of FIG. 1.

In addition, referring still to FIG. 1 and also to FIG. 2, the jack 10 further includes a wiring board 20 formed of conventional materials. The wiring board 20 may be a single layer board or may have multiple layers. The wiring board 20 may be substantially planar as illustrated, or may be non-planar.

Referring again to FIGS. 1 and 1A, contact wires 22*a*, 22*b*, 24*a*, 24*b*, 26*a*, 26*b*, 28*a*, 28*b* are attached to the wiring board 20. As described in U.S. Pat. No. 6,350,158 referenced above, the contact wires 22*a*, 22*b*, 24*a*, 24*b*, 26*a*, 26*b*, 28*a*, 28*b* have free ends that have substantially the same profile, are substantially transversely aligned in side-by-side relationship, and that extend into the plug aperture 14 to form electrical contact with the terminal blades of a mating plug. The free ends of the contact wires 22*a*, 22*b*, 24*a*, 24*b*, 26*a*, 26*b*, 28*a*, 28*b* extend into individual slots 29*a*-29*h* in the forward edge portion of the wiring board 20. The contact wires 22*a*, 22*b*, 24*a*, 24*b*, 26*a*, 26*b*, 28*a*, 28*b* are arranged in pairs defined by TIA 568B, with wires 22*a*, 22*b* (pair 1) being adjacent to each other and in the center of the sequence of wires, wires 24*a*, 24*b* (pair 2) being adjacent to each other and occupying the leftmost two positions (from the vantage point of FIG. 1B) in the sequence, wires 28*a*, 28*b* (pair 4) being adjacent to each other and occupying the rightmost two positions (from the vantage point of FIG. 1B) in the sequence, and wires 26*a*, 26*b* (pair 3) being positioned between, respectively, pairs 1 and 4 and pairs 1 and 2. The wires 22*a*, 22*b*, 24*a*, 24*b*, 26*a*, 26*b*, 28*a*, 28*b* are mounted to the wiring board 20 via insertion into respective apertures 32*a*, 32*b*, 34*a*, 34*b*, 36*a*, 36*b*, 38*a*, 38*b*, which are arranged in the illustrated embodiment in a "dual diagonal" pattern known to those skilled in this art as described in U.S. Pat. No. 6,196,880 to Goodrich et al., the disclosure of which is hereby incorporated herein in its entirety. Those skilled in this art will appreciate that contact wires or other contacts of other configurations may be used. As one example, contact wires configured as described in aforementioned U.S. Pat. No. 5,975,919 to Arnett et al. may be employed.

Figure 3:
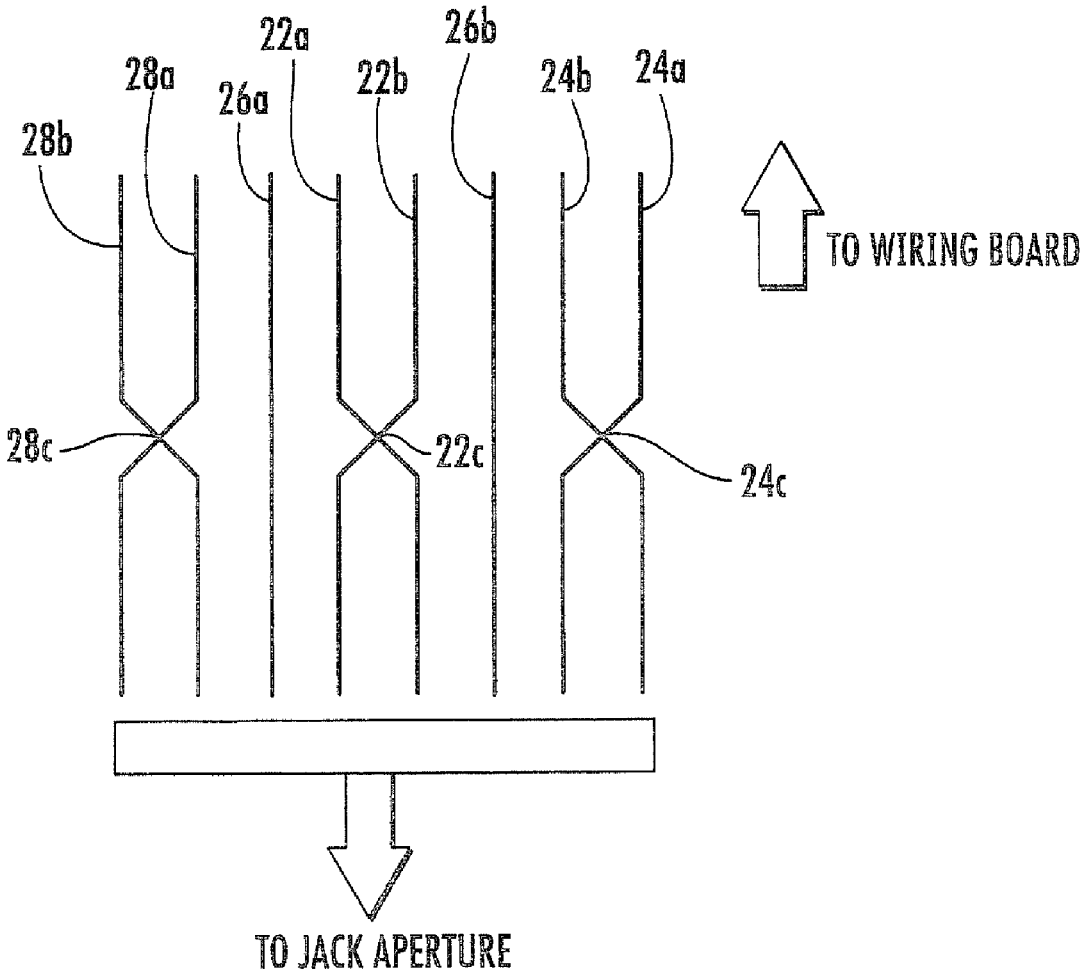
FIG. 3 is a top schematic view of contact wires of the prior art jack of FIG. 1.

As can be seen in FIGS. 1A and 3, each of pairs 1, 2 and 4 that comprise adjacent contact wires include a respective "crossover" 22*c*, 24*c*, 28*c*, i.e., a location in which the contact wires of a pair cross each other without making electrical contact, typically such that the free end of one contact wire of the pair is substantially longitudinally aligned with the fixed end portion of the other contact wire of the pair. The crossovers 22*c*, 24*c*, 28*c* are located approximately in the center of their contact wires (between the free ends of the contact wires and their mounting locations on the wiring board 20). Crossovers are included to provide compensatory crosstalk between contact wires. In the illustrated embodiment, the crossovers are implemented via complementary localized bends in the crossing wires, with one wire being bent upwardly and the other wire being bent downwardly. The presence of a crossover, structural implementations thereof, and its effect on crosstalk are discussed in some detail in the '358 patent described above and U.S. Pat. No. 5,186,647 to Denkmann et al., the disclosure of which is hereby incorporated herein by reference. In this prior art device, the contact wires of pair 3 (wires 26*a*, 26*b*) do not include a crossover.

Figure 1B:
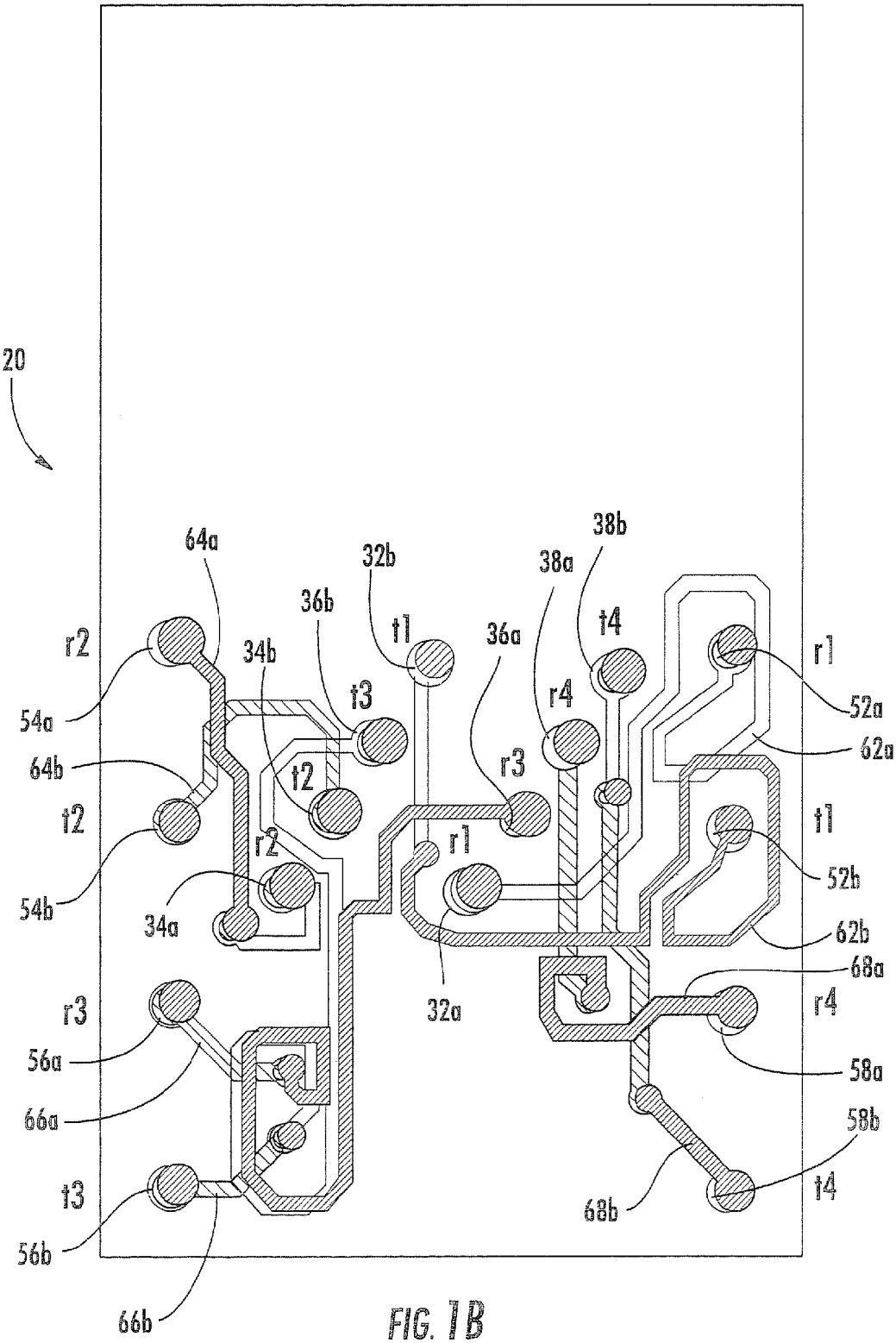
FIG. 1B is a top view of the wiring board of FIG. 1A.

Referring once again to FIGS. 1 and 1A and to FIG. 1B, eight insulation displacement connectors (IDCs) 42*a*, 42*b*, 44*a*, 44*b*, 46*a*, 46*b*, 48*a*, 48*b* are inserted into eight respective IDC apertures 52*a*, 52*b*, 54*a*, 54*b*, 56*a*, 56*b*, 58*a*, 58*b*. The IDCs are of conventional constriction and need not be described in detail herein; exemplary IDCs are illustrated and described in U.S. Pat. No. 5,975,919 to Arnett, the disclosure of which is hereby incorporated by reference herein in its entirety.

Referring now to FIGS. 1A, 1B and 2, the each of the wire apertures 32*a*, 32*b*, 34*a*, 34*b*, 36*a*, 36*b*, 38*a*, 38*b* is electrically connected to a respective IDC aperture 52*a*, 52*b*, 54*a*, 54*b*, 56*a*, 56*b*, 58*a*, 58*b* via a respective conductor 62*a*, 62*b*, 64*a*, 64*b*, 66*a*, 66*b*, 68*a*, 68*b*, thereby interconnecting each of the contact wires 22*a*, 22*b*, 24*a*, 24*b*, 26*a*, 26*b*, 28*a*, 28*b* to its corresponding IDC 42*a*, 42*b*, 44*a*, 44*b*, 46*a*, 46*b*, 48*a*, 48*b*. The conductors 62*a*, 62*b*, 64*a*, 64*b*, 66*a*, 66*b*, 68*a*, 68*b* are formed of conventional conductive materials and are deposited on the wiring board 20 via any deposition method known to those skilled in this art to be suitable for the application of conductors. Some conductors are illustrated as being entirely present on a single layer of the wiring board 20 (for example, conductor 62*a*), while other conductors (for example, conductor 62*b*) may reside on multiple layers of the wiring board 20; conductors can travel between layers through the inclusion of vias (also known as plated through holes) or other layer-transferring structures known to those skilled in this art.

U.S. Pat. No. 5,967,853 to Hashim (the disclosure of which is hereby incorporated herein in its entirety) describes a technique whereby capacitive compensation is used to simultaneously compensate differential to differential and differential to common mode crosstalk. However, in order to effectively cancel both NEXT and FEXT it is typically necessary to provide both inductive and capacitive compensation. The prior art arrangement of contact wires disclosed in FIGS. 1-3 has been proven to effectively and efficiently provide inductive differential to differential crosstalk compensation. However, it has been determined that this arrangement may be ineffective, and perhaps counterproductive, in providing inductive differential to common mode compensation in the jack 10. More specifically, the prior art arrangement provides inductive differential to differential crosstalk compensation between pairs 1 and 3, pairs 2 and 3, and pairs 4 and 3, but in the development of the present invention it has been recognized that, due to the large physical separation between the conductors of pair 3 and their asymmetric placement relative to pair 2 (and similarly to pair 4 ), the highest levels of differential to common mode crosstalk in a mating plug, which can be the most problematic to channel performance, tend to occur on pairs 2 and 4 when pair 3 is excited differentially. The differential to common mode crosstalk occurring when any of the pairs 1, 2 and 4 is excited differentially tends to be much less severe, and consequently much less problematic, because the separation between the conductors in each of these pairs is one-third the separation between the conductors of pair 3. In the prior art arrangement of contact wires disclosed in FIGS. 1-3, crossover on each of pairs 1, 2 and 4 inductively compensates for the less severe differential to common mode crosstalk occurring when any of these pairs is differentially excited. However, due to the absence of a crossover on pair 3, this arrangement not only fails to inductively compensate for the more severe common mode crosstalk on pairs 2 and 4 when pair 3 is differentially excited, but can actually exacerbate this problem. This is especially true when the jack receives a conventional plug such as the one illustrated in U.S. Pat. No. 6,250,949 to Lin.

Figure 4:
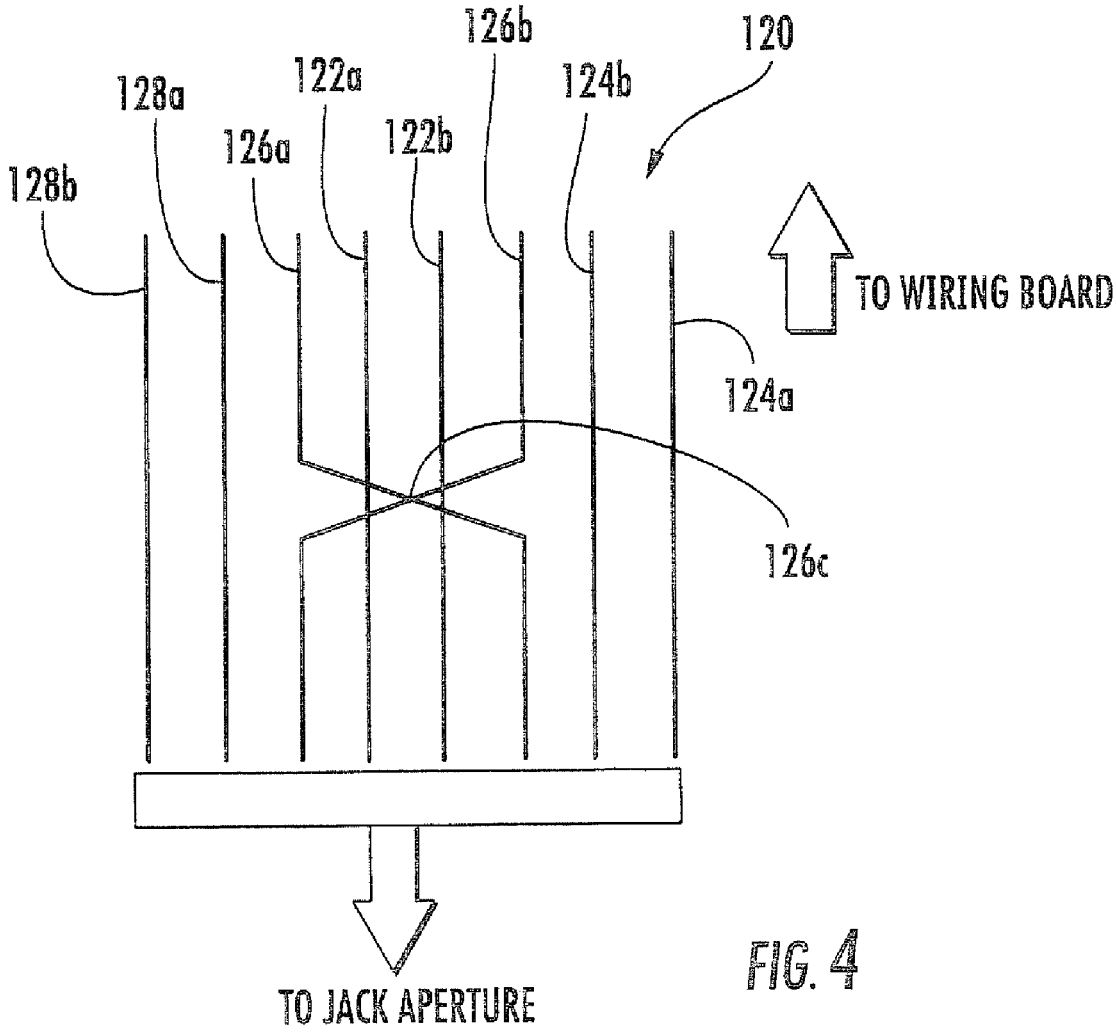
FIG. 4 is a top schematic view of contact wires of an embodiment of a communications jack according to the present invention.

Turning now to FIG. 4, an arrangement of wires according to embodiments of the present invention, designated broadly at 120, is illustrated schematically therein. The wiring arrangement 120 includes eight contact wires 122*a*, 122*b*, 124*a*, 124*b*, 126*a*, 126*b*, 128*a*, 128*b* that comprise, respectively, wire pairs 1, 2, 3 and 4. In contrast to the prior art arrangement of contact wires described above, in this embodiment the contact wires 122*a*, 122*b* of pair 1, the contact wires 124*a*, 124*b* of pair 2, and the contact wires 128*a*, 128*b* of pair 4 do not include a crossover, while the contact wires 126*a*, 126*b* include a crossover 126*c*.

Like the prior arrangement, this arrangement of contact wires should provide compensatory inductive differential to differential crosstalk between pairs 1 and 3, pairs 2 and 3, and pairs 4 and 3. In addition, this arrangement, although not inductively compensating for the less severe differential to common mode crosstalk occurring when any of the pairs 1, 2 and 4 is differentially excited, can provide inductive compensation for the highly problematic differential to common mode crosstalk occurring on pairs 2 and 4 when pair 3 is differentially excited. Because the most problematic differential to common mode crosstalk can be inductively compensated, a jack employing this arrangement can meet higher performance standards, particularly at elevated frequencies.

An exemplary implementation of this arrangement is illustrated in FIGS. 5-7A, in which a jack 200 according to embodiment of the present invention is shown. The jack 200 includes a jack frame 212 having a plug aperture 214, a cover 216 and a terminal housing 218. A wiring board 220 includes IDCs 242*a*-248*b* mounted thereon. Contact wires 222*a*-228*b* are mounted to the wiring board 220. At their free ends, the contact wires 222*a*-228*b* fit within slots 229*a*-229*h* located at the forward end of the wiring board 220 and are positioned to mate with the blades of a plug inserted into the plug aperture 214. With the exception of the crossover region 226*c*, described in greater detail below, the contact wires 222*a*-228*b* follow generally the same profile until they bend downwardly into their respective mounting apertures in the wire board 220. Conductive traces on the wiring board 220 provide signal paths between the contact wires 222*a*-228*b* and the IDCs 242*a*-248*b*.

Figure 5:
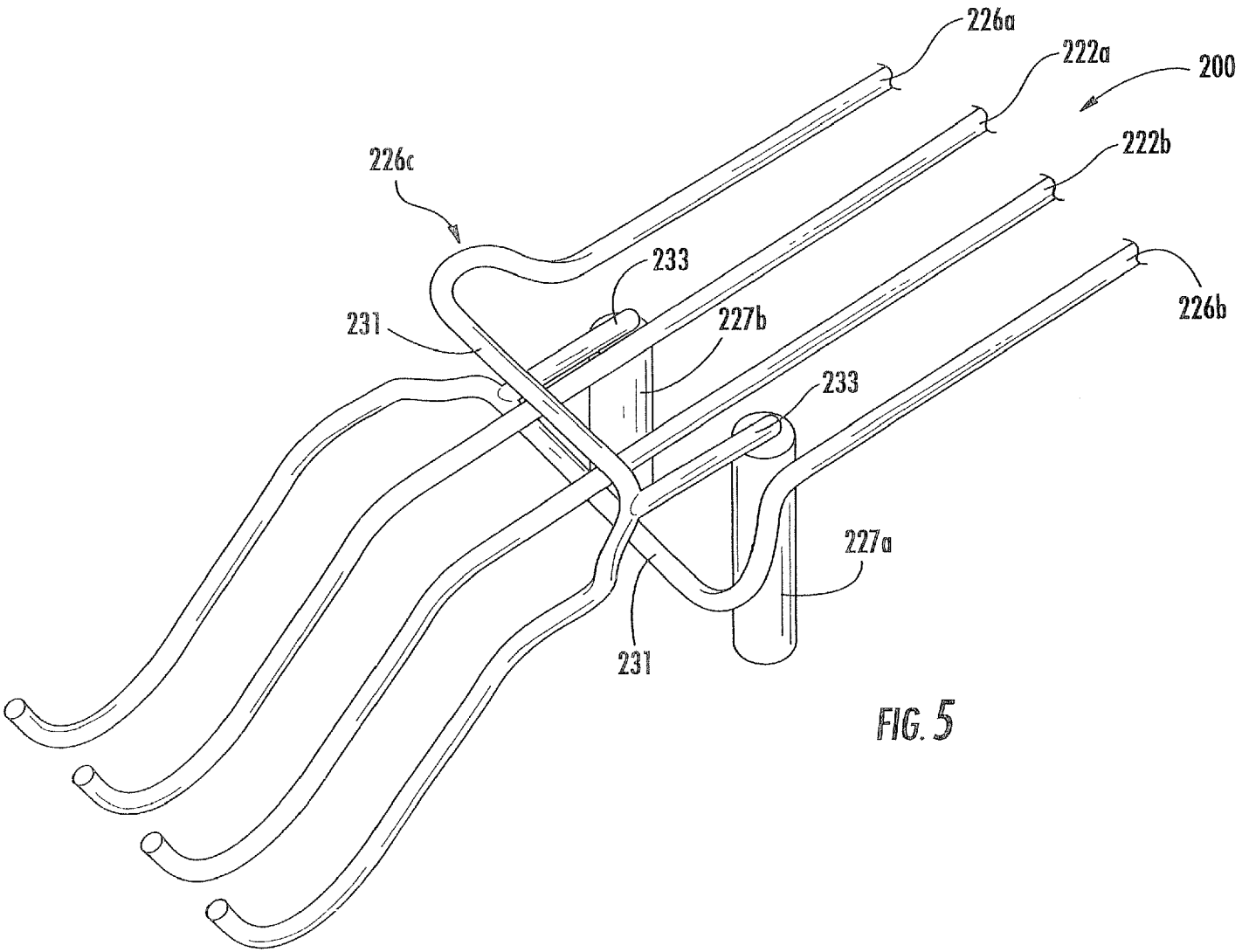
FIG. 5 is an enlarged perspective view of contact wires following the configuration illustrated in FIG. 4 according to embodiments of the present invention.

Referring now to FIG. 5, the contact wires 226*a*, 226*b* form the crossover 226*c* with the assistance of supports 227*a*, 227*b*. Each of the contact wires 226*a*, 226*b* includes a transversely-extending crossover segment 231 that travels either over (in the case of the contact wire 226*a*) or under (in the case of contact wire 226*b*) the contact wires 222*a*, 222*b*. Each of the contact wires 226*a*, 226*b* also includes a support finger 233 that extends rearwardly from the crossover segment 231 to rest atop a respective support 227*a*, 227*b*. The supports 227*a*, 227*b* extend upwardly from the wiring board 220 from locations approximately halfway between the free ends of the contact wires 226*a*, 226*b* and their mounting locations 236*a*, 236*b* in the wiring board 220. In some embodiments the support finger 233 of each contact wire 226*a*, 226*b* may extend from its crossover segment at substantially the same angle, such that the supports 227*a*, 227*b* are of different heights in order to support the crossover segment 231 of each contact wire 226*a*, 226*b* at the proper elevation. In other embodiments, the supports 227*a*, 227*b* may be of the same height, and the support finger 231 of each crossover segment may extend therefrom at different angles, or the supports may be of different heights and the fingers may extend at different angles.

This configuration enables the free ends of the contact wires 226*a*, 226*b* to deflect in response to the insertion of a plug in the plug aperture 214 without contacting the contact wires 222*a*, 222*b*. The illustrated embodiment has the advantage of enabling the commencement of the inductive differential to differential and differential to common mode compensations at minimal delay from the corresponding crosstalk sources, which can be important to effective crosstalk compensation. The separation between the crossover segments 231 and the locations where the contact wires 222*a*, 222*b* intercept a mating plug is about 0.154 inches, but those skilled in this art will appreciate that a separation gap of a different size may also be suitable with the present invention. Typically the contact wires are between about 0.648 and 0.828 inches in length, and the crossover 226*c* occurs between about 0.3 and 0.4 inches from the free ends of the contact wires 226*a*, 226*b*.

The skilled artisan will recognize that, although eight contact wires are illustrated and described herein, other numbers of contact wires may be employed. For example, 16 contact wires may be employed, and one or more crossovers that cross over a pair of contact wires sandwiched therebetween may be included in those contact wires.

Further, those skilled in this art will recognize that other jack configurations may also be suitable for use with the present invention. For example, as discussed above, other configurations of jack frames, covers and terminal housings may also be employed with the present invention. As another example, the contact wires may have a different profile (an exemplary alternative profile is depicted in U.S. Pat. No. 5,975,919 to Arnett et al.), or they may by replaced by conductive paths on a flexible circuit, and they may mount in locations that do not follow the "dual diagonal" mounting scheme illustrated herein (an exemplary alternative is illustrated in U.S. Pat. No. 6,116,964 to Goodrich et al). As a further example, the IDCs may mount in a different pattern on the wiring board, or some other type of connector may be used. Those skilled in this art will also recognize that embodiments of the wiring board described above may be employed in other environments in which a communications jack may be found. For example, jacks within a patch panel or series of patch panels may be suitable for use with such wiring boards. Other environments may also be possible. It may also be recognized that the contact wires may not include any crossovers on any of the pairs, but rather the wiring board to which they are attached can have its signal carrying conductive paths routed in accordance with the crossover scheme described generally in FIG. 4.

Moreover, those skilled in this art will further recognize that the crossover of pair 3 described above can be implemented, with similar beneficial effect on differential to common mode crosstalk conversion, by forming the conductor leads of jacks utilizing metallic lead-frame structures instead of printed wiring boards to achieve the required connectivity and crosstalk compensation. In such a configuration, the contact wires and/or the insulation displacement connectors may be formed integrally with the conductors as unitary members.

The configuration illustrated and described herein can provide connectors, and in particular communications jacks, that exhibit improved crosstalk characteristics, particularly at elevated frequencies. For example, a connector such as that illustrated in FIGS. 5-7A and mated with a conventional plug may have channel alien NEXT of less than −60 dB power sum at 100 MHz, and less than −49.5 dB power sum at 500 MHz.

Also those skilled in the art will recognize that in situations where it may not be critical to implement the differential to differential crosstalk compensation between pairs 3 and 2 and between pairs 3 and 4 in the contact wires, it is possible to provide instead compensation for the common mode crosstalk induced on pair 3, or pair 1, when either of pair 2 or pair 4 is differentially excited, by modifying the contact wire crossover scheme of FIG. 4 to include crossovers in pairs 2 and 4 in addition to the crossover on pair 3.

Further, those skilled in the art will recognize the reciprocity that exists between the differential to common mode crosstalk induced on a first pair, when a second pair is excited differentially, and the common mode to differential signal induced on the second of these pairs when the first of these pairs is excited common-modally, with the common mode to differential crosstalk equaling the differential to common mode crosstalk multiplied by a constant, that constant being the ratio of the differential to common mode impedances. Consequently, when an improvement occurs, due to the current invention, in the differential to common mode crosstalk between two pairs when one of these pairs is excited differentially, a corresponding improvement occurs in the common mode to differential crosstalk between these two pairs, when the other of these pairs is excited common-modally.

The invention is described in greater detail herein in the following non-limiting example.

EXAMPLE

Communication jacks of the configuration illustrated in FIG. 1, mated with conventional plugs, were modeled and solved using finite element electromagnetic field simulation software. In one jack model designated "experimental jack", the contact wire crossover configuration substantially matched the embodiment of the current invention illustrated in FIGS. 5-7A. In a second jack model, designated "prior art jack", the contact wire crossover configuration substantially matched the prior art jack illustrated in FIGS. 1-3. The jack models were then solved for differential to common mode NEXT and FEXT crosstalk.

Differential to Common Mode Results for the problematic 3-2 and 3-4 pair combinations, where pair 3 is the differentially excited pair, are shown in FIGS. 8A-8D and FIGS. 9A-9D. For each of these pair combinations results are provided for forward NEXT, forward FEXT, reverse FEXT and reverse NEXT, wherein the term "forward" represents the testing orientation in which the excitation is injected from the cordage end of the plug and term "reverse" represents the testing orientation in which the excitation is injected from building cable end of the jack. It can be seen that in all these cases the experimental jack employing the pair 3 crossover exhibited significant improvements in differential to common mode crosstalk (i.e. lower decibel levels) over the prior art jack, within the frequency band of interest of 10-500 MHz.

Figure 10:
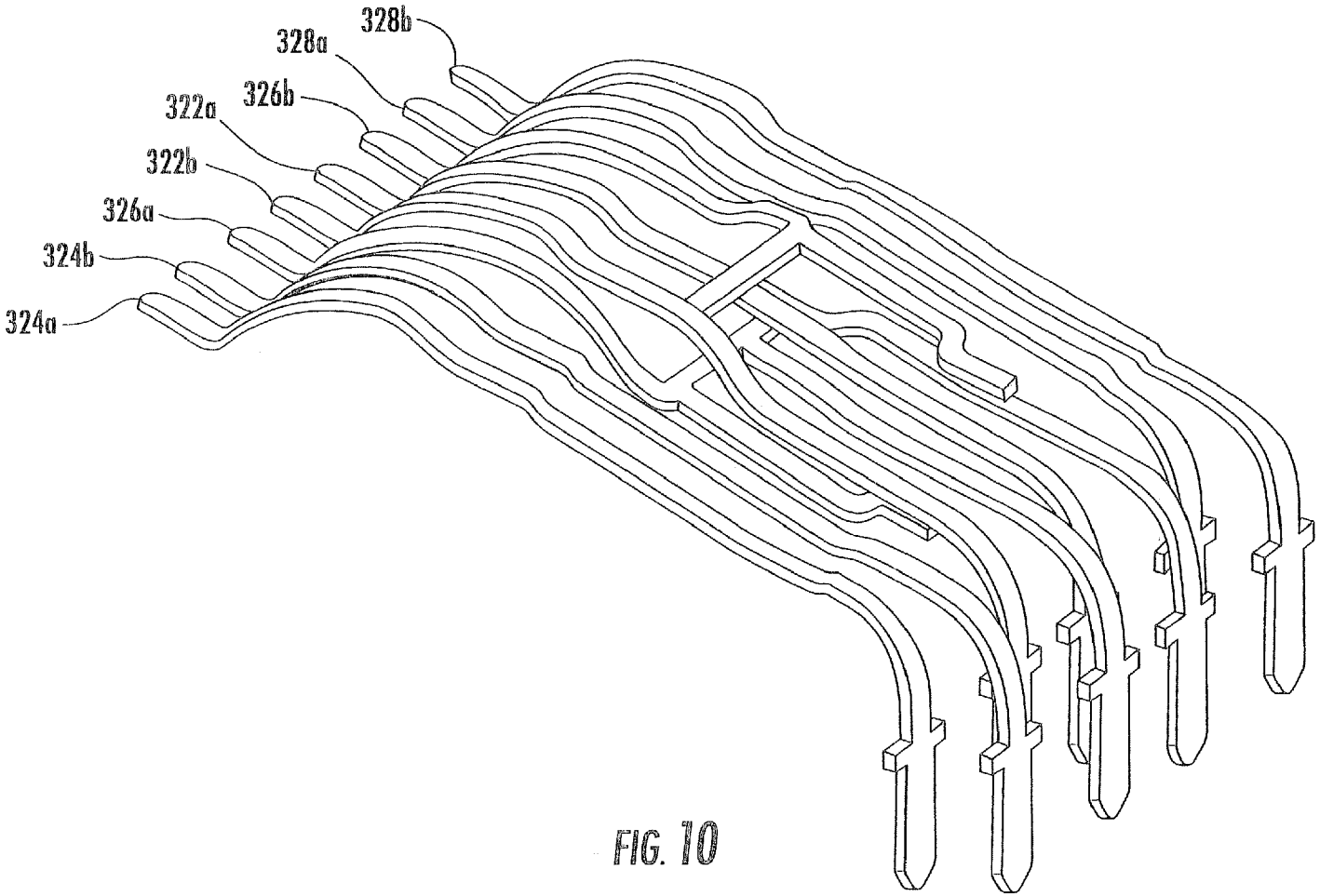
FIG. 10 is a perspective view of contact wires of a communications jack according to further embodiments of the present invention.
Figure 11:
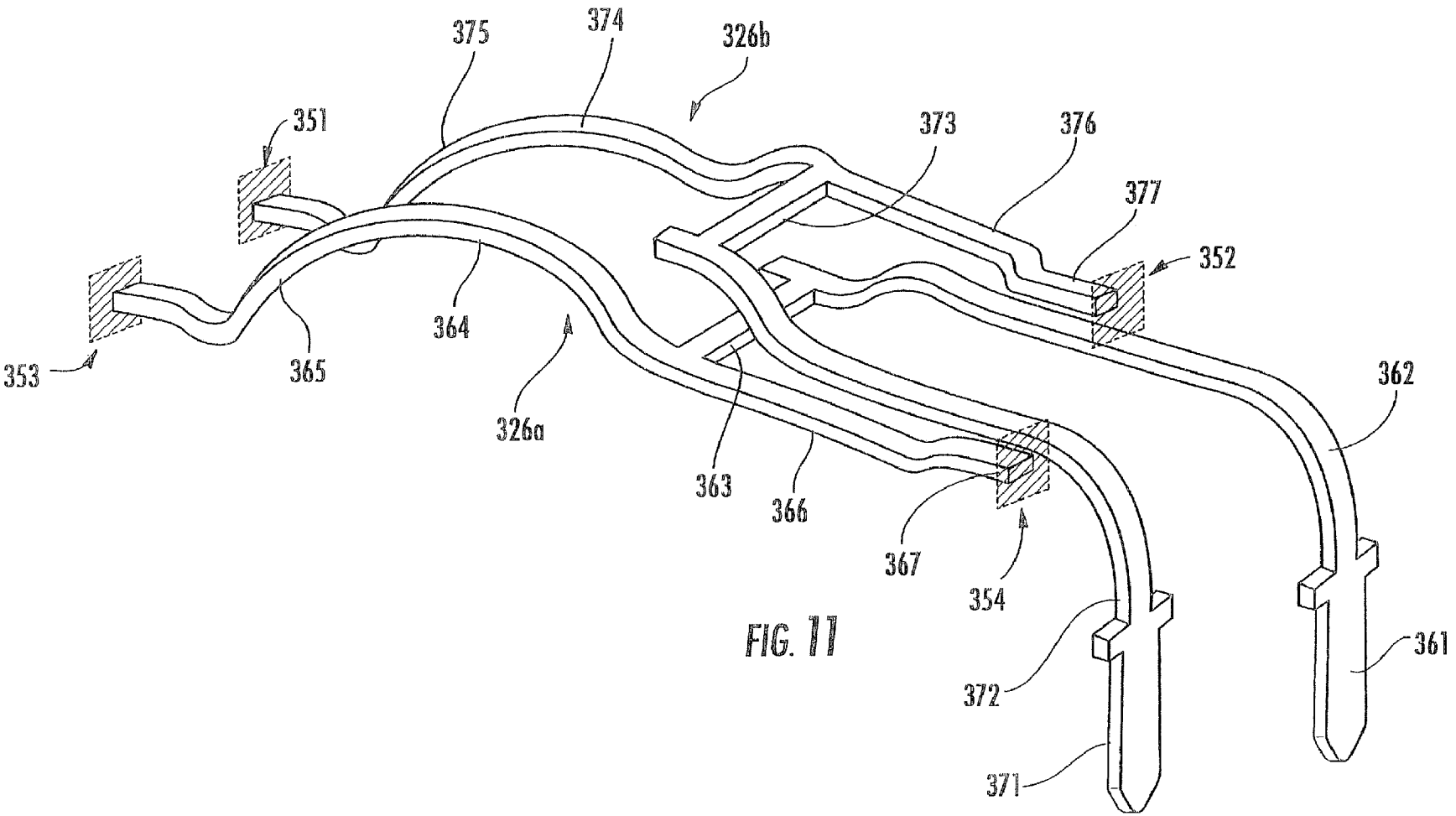
FIG. 11 is a perspective view of two of the contact wires depicted in FIG. 10 that shows how those contact wires engage a plurality of stops.
Figure 12:
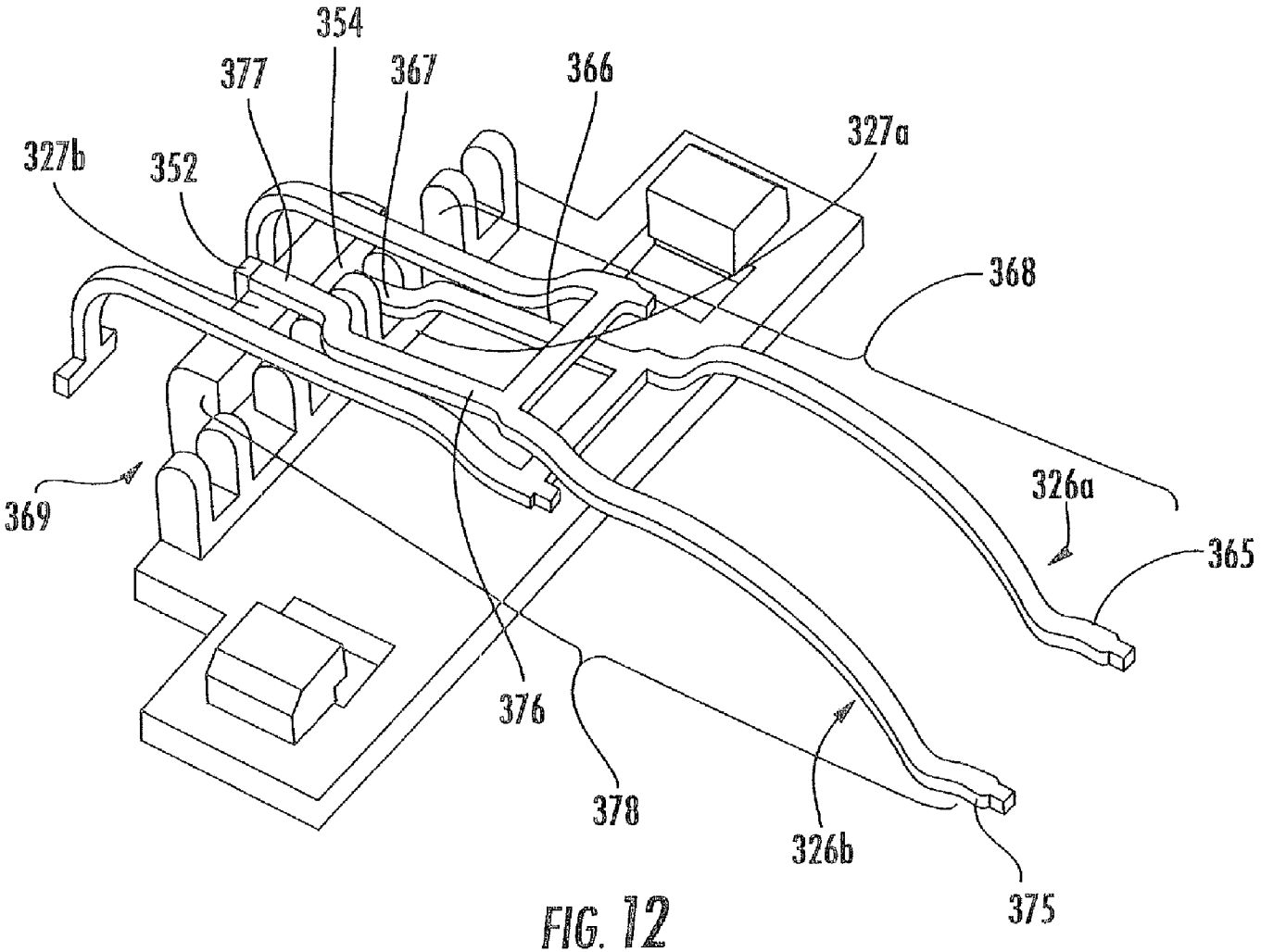
FIG. 12 is a perspective view of the two contact wires of FIG. 11 mounted on a support structure of the communications jack.
Figure 13:
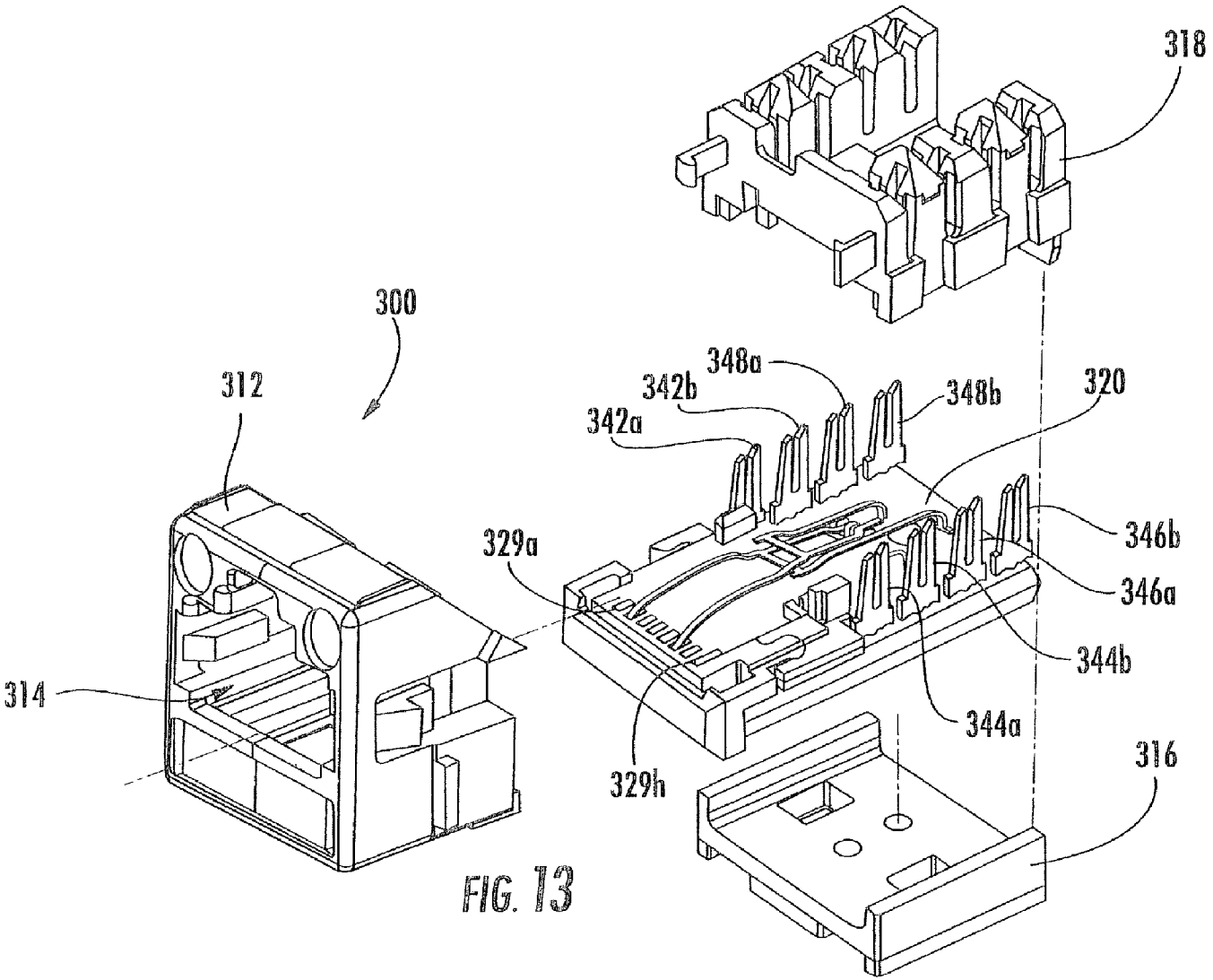
FIG. 13 is an exploded perspective view of a communications jack according to embodiments of the present invention that includes the contact wire configuration of FIG. 10 with all but two of the contact wires removed.

FIGS. 10-13 illustrate a communications jack 300 according to further embodiments of the present invention. In particular, FIG. 10 illustrates the contact wire configuration for the jack 300, FIG. 11 shows how two of the contact wires of FIG. 10 may interact with a plurality of stops, FIG. 12 illustrates one implementation for two of the stops of FIG. 11, and FIG. 13 is an exploded perspective view of the entire jack 300 with six of the contact wires removed.

As shown in FIG. 13, the jack 300 includes a jack frame 312 having a plug aperture 314 for receiving a mating plug, a cover 316, a terminal housing 318, a wiring board 320, and a plurality of insulation displacement connectors (IDCs) 342*a*, 342*b*, 344*a*, 344*b*, 346*a*, 346*b*, 348*a*, 348*b*. The wiring board 320 is located at least partially within the housing of the jack 300 (in jack 300 the housing comprises the jack frame 312, the cover 316 and the terminal housing 318). These components are conventionally formed and/or are described above with respect to other embodiments of the present invention, and hence will not be described in further detail herein. Those skilled in this art will recognize that other configurations of jack frames, covers, terminal housings, wiring boards and IDCs may also be employed in further embodiments of the present invention.

As shown best in FIG. 10, the jack 300 further includes eight contact wires 322*a*, 322*b*, 324*a*, 324*b*, 326*a*, 326*b*, 328*a*, 328*b*. In the jack 300 the free ends of the contact wires 322*a*, 322*b*, 324*a*, 324*b*, 326*a*, 326*b*, 328*a*, 328*b* have substantially the same profile and are substantially transversely aligned in side-by-side relationship. However, it will be appreciated that other configurations may also be used. As shown best in FIG. 13, the free ends of the contact wires 322*a*, 322*b*, 324*a*, 324*b*, 326*a*, 326*b*, 328*a*, 328*b* extend into the plug aperture 314 of the jack to form electrical contact with the blades of a mating plug (not shown in FIGS. 10-13). The free ends of the contact wires 322*a*, 322*b*, 324*a*, 324*b*, 326*a*, 326*b*, 328*a*, 328*b* extend into individual slots 329*a*-329*h* in the forward edge portion of the wiring board 320. The contact wires 322*a*, 322*b*, 324*a*, 324*b*, 326*a*, 326*b*, 328*a*, 328*b* are arranged in pairs defined by TIA 568B, and are mounted to the wiring board 320 via insertion into respective apertures (not shown) in the wiring board 320. As in the above-described embodiments of the present invention, the contact wires 322*a*, 322*b*, 324*a*, 324*b*, 326*a*, 326*b*, 328*a*, 328*b* are electrically connected to the IDCs 342*a*, 342*b*, 344*a*, 344*b*,346*a*, 346*b*, 348*a*, 348*b* via conductors (not shown) formed on and/or in the wiring board 320.

The eight contact wires 322*a*, 322*b*, 324*a*, 324*b*, 326*a*, 326*b*, 328*a*, 328*b* comprise, respectively, wire pairs 1, 2, 3 and 4. As with the previous embodiment, the contact wires 322*a*, 322*b* of pair 1, the contact wires 324*a*, 324*b* of pair 2, and the contact wires 328*a*, 328*b* of pair 4 do not include a crossover, while the contact wires 326*a*, 326*b* include a crossover. Thus, this contact wire arrangement should provide compensatory inductive differential to differential crosstalk between pairs 1 and 3, pairs 2 and 3, and pairs 4 and 3, as well as inductive compensation for the differential to common mode crosstalk occurring on pairs 2 and 4 when pair 3 is differentially excited.

As shown best in FIG. 11, the contact wires 326*a*, 326*b* of pair 3 each include a fixed end portion 362, 372 that includes a termination (also referred to as a "fixed end") 361, 371 that is mounted in the wiring board 320, a deflectable free end portion 363, 373, and a support finger 366, 376. The deflectable free end portion of each contact wire 326*a*, 326*b* includes a crossover segment 363, 373 and a plug contact region 364, 374 where each contact 326*a*, 326*b* contacts a respective blade of a mating plug. The portion of contact wire 326*a* forming a direct path between the fixed end 361 and the far end of the free end portion 363 comprises an intermediate portion of the contact wire 326*a*. The support finger 366 branches off of this intermediate portion. Likewise, the portion of contact wire 326*b* forming a direct path between the fixed end 371 and the far end of the free end portion 373 comprises an intermediate portion of the contact wire 326*b*. The support finger 376 branches off of this intermediate portion. In the embodiment of FIGS. 10-13, the crossover segments 363, 373 are transversely-extending crossover segments that travel either over (in the case of the contact wire 326*b*) or under (in the case of contact wire 326*a*) the contact wires 322*a*, 322*b*. The support fingers 366, 376 each extend rearwardly from the crossover segment 363, 373, and each support finger includes a respective distal end 367, 377. As shown in FIG. 12, the distal ends 367, 377 of the support fingers 366, 376 rest atop respective supports 327*a*, 327*b*. In the pictured embodiment, the supports 327*a*, 327*b* are at different elevations above the top surface of the wiring board 320 in order to support the respective crossover segments 363, 373 of contact wires 326*a*, 326*b* at the proper elevation. It will be appreciated, however, that in other embodiments, the supports 327*a*, 327*b* may be of the same height and/or that the support fingers 366, 376 of each crossover segment may extend therefrom at different angles, or the supports may be of different heights and the fingers may extend at different angles.

Referring now to FIG. 12, note that, because of the extended length of the transverse crossover segment, the plug contact region 364, 374 of contacts 326*a*, 326*b* may be offset by a relatively large distance from the respective fixed end 361, 371 of each contact. As such, the contacts 326*a*, 326*b* may not have sufficient support which, in certain circumstances, may allow one or both of the contacts 326*a*, 326*b* to make physical and electrical contact with one or both of contacts 322*a*, 322*b* when the contacts of the jack 300 are deflected as a mating connector is received within the plug aperture 314. Thus, as discussed above, each contact 326*a*, 326*b* may include a respective support finger 366, 376 that engages a respective support element 327*a*, 327*b* to ensure that sufficient support is provided so that such short-circuiting of either or both contacts 326*a*, 326*b* will not occur. As shown best in FIGS. 11 and 12, the distal ends 367, 377 of the respective support fingers 366, 376 do not terminate into the wiring board 320 in this particular embodiment of the present invention, as the signal carrying path to the wiring board is through the crossover segment 363 and fixed end portion 362 for contact 326*a* and through the crossover segment 373 and fixed end portion 372 for contact 326*b*. Instead, the distal ends 367, 377 of the support fingers 366, 376 engage respective supports 327*a*, 327*b* (see FIG. 12) to provide sufficient support so that the contact wires 326*a*, 326*b* do not make physical contact with any of the other contact wires during normal operation of the jack 300.

As shown in FIG. 12, pursuant to embodiments of the present invention, the support finger 366 and the free end 365 of contact 326*a* may form a beam structure 368. This beam structure 368 may absorb all or practically all of the strain experienced by the contact wire 326*a* in response to insertion of a mating plug into the plug aperture 314, and thus provides the contact force that holds the contact 326*a* against a corresponding blade of the plug such that a reliable electrical connection is established between the plug blade and contact 326*a*. As such, the crossover segment 363 of contact 326*a* and the fixed end portion 362 need not absorb any of the strain for contact wire 326*a*. In fact, in some embodiments, the crossover segment 363 of contact 326*a* and the fixed end portion 362 could be replaced by electrical lead wires (i.e., non-flexure members) that merely provide a conductive path from the contact 326*a* onto the wiring board 320. Similarly, the support finger 376 and the free end 375 of contact 326*b* may form a beam structure 378. This beam structure 378 may absorb all or practically all of the strain experienced by contact wire 326*b* in response to insertion of a mating plug into the plug aperture 314, and thus provides the contact force that holds the contact 326*b* against a corresponding blade of the plug such that a reliable electrical connection is established between the plug blade and contact 326*b*. As such, the crossover segment 373 of contact 326*b* and the fixed end portion 372 need not absorb any of the strain for contact wire 326*b*.

As shown best in FIGS. 11 and 12, a plurality of stops 351-354 may be included in the connector 300. In particular, a stop 353 may be provided adjacent the free end 365 of contact 326*a*, a stop 351 may be provided adjacent the free end 375 of contact 326*b*, a stop 354 may be provided adjacent the distal end 367 of the support finger 366 of contact 326*a*, and a stop 352 may be provided adjacent the distal end 377 of the support finger 376 of contact 326*b*. These stops 351-354 may be implemented, for example, as plastic walls in the contact dividing structure 369, although it will be appreciated that numerous other ways of implementing these stops are possible. The plastic stops 354 and 352 may facilitate preventing over-bending of the crossover segments 363 and 373, respectively, when a mating plug is inserted into the plug aperture 314. The plastic stops 353 and 351 may facilitate preventing over-bending of the crossover segments 363 and 373 when a mating plug is removed from the plug aperture 314.

Also, neither the distal ends 367, 377 of the support fingers 366, 376 nor the free ends 365, 375 of the contacts 326*a*, 326*b* are fixedly mounted in the embodiment of FIGS. 10-13. Instead, as shown best in FIG. 12 the distal ends 367, 377 of the support fingers 366, 376 of the contacts 326*a*, 326*b* are supported by the supports 327*a*, 327*b*, respectively. The free ends 365, 375 of the contacts 326*a*, 326*b* may likewise be supported by the top surface of the wiring board 320 when a mating plug is received in the jack aperture 314 (and may or may not engage the wiring board 320 in the absence of a mating plug). Thus, both the distal ends 367, 377 of the support fingers 366, 376 and the free ends 365, 375 of the contacts 326*a*, 326*b* may move some distance when a mating plug is inserted into and/or removed from the plug aperture until these ends engage the respective stops 351-354 which prevent further movement. By leaving both the distal ends 367, 377 of the support fingers 366, 376 and the free ends 365, 375 of the contacts 326*a*, 326*b* unclamped (i.e., not fixedly mounted), improved flexture may be provided and the overall length of the portion of the contacts 326*a*, 326*b* forming the beams 368 and 378 may be correspondingly reduced if desired.

In operation, the free ends 365, 375 of the contact wires 326*a*, 326*b* deflect in response to the insertion of a plug in the plug aperture 314 without contacting the contact wires 322*a*, 322*b*. The illustrated embodiment has the advantage of enabling the commencement of the inductive differential to differential and differential to common mode compensations at minimal delay from the corresponding crosstalk sources, which can be important to effective crosstalk compensation. The separation between the crossover segments 363, 373 and the location where the contact wires 322*a*, 322*b* intercept a mating plug is about 0.15 inches, but those skilled in this art will appreciate that a separation gap of a different size may also be suitable with the present invention.

Figure 6:
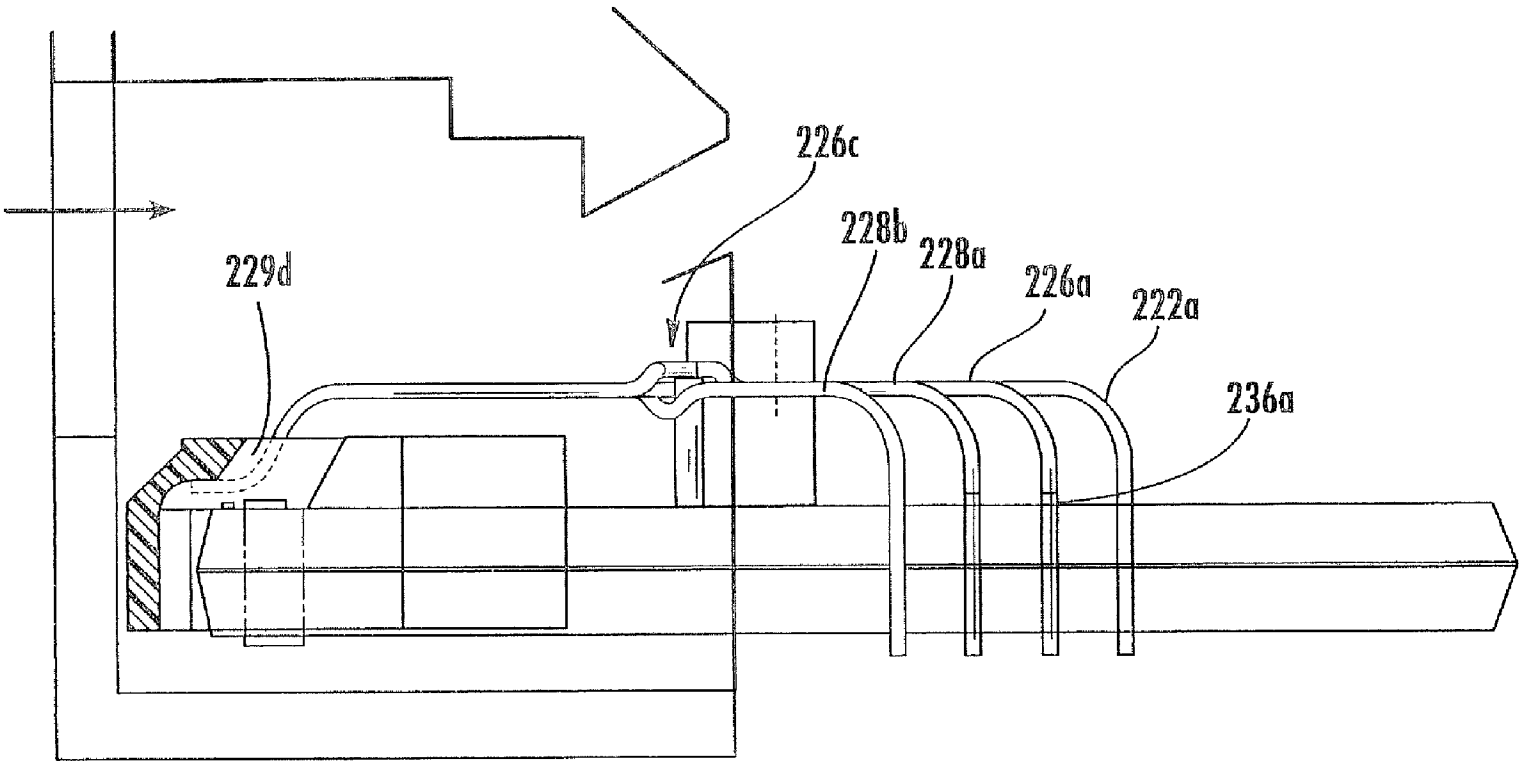
FIG. 6 is an enlarged side view of contact wires of FIG. 5 in a wiring board.
Figure 7:
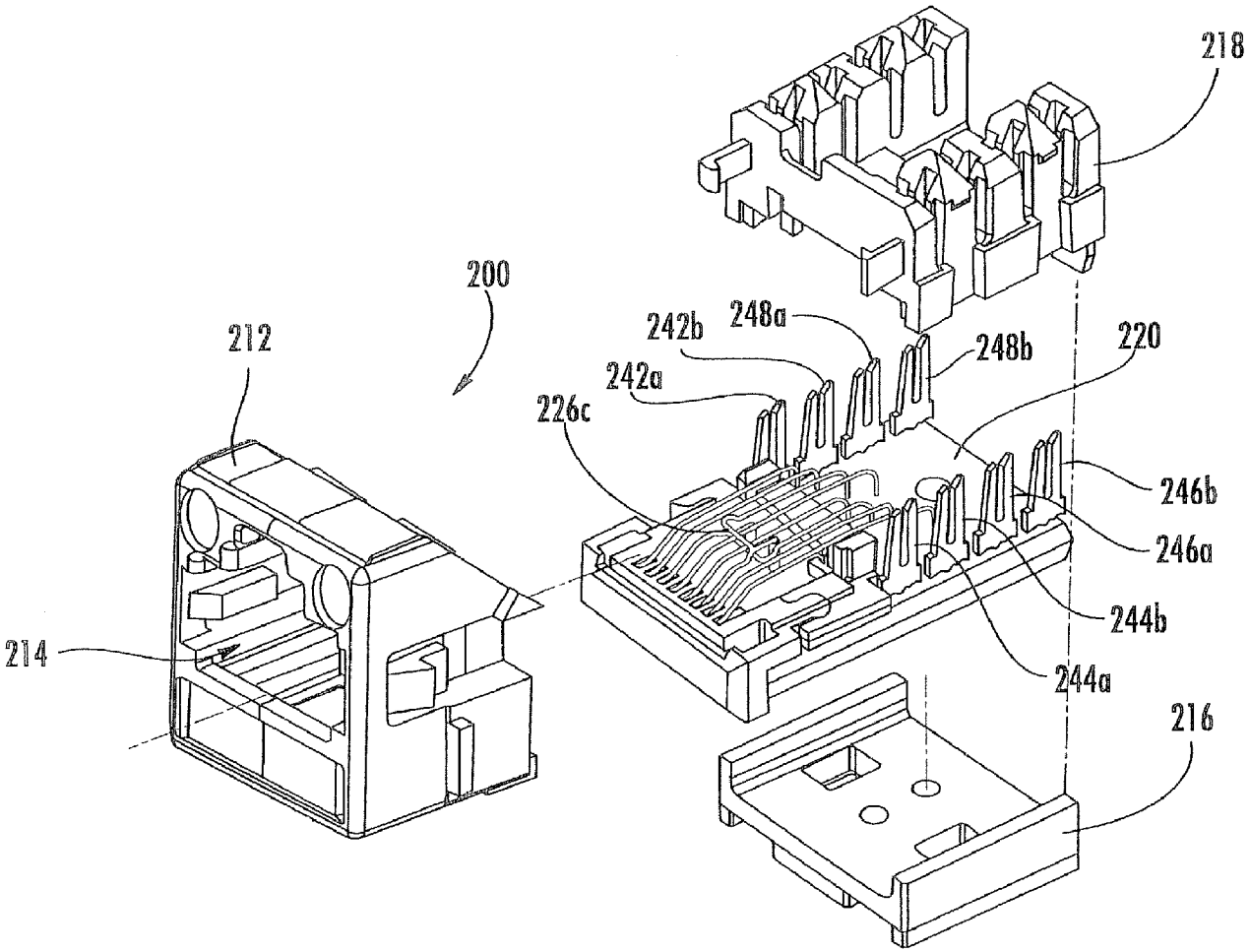
FIG. 7 is a perspective view of a communications jack that includes the contact wires of FIG. 5 according to embodiments of the present invention.
Figure 7A:
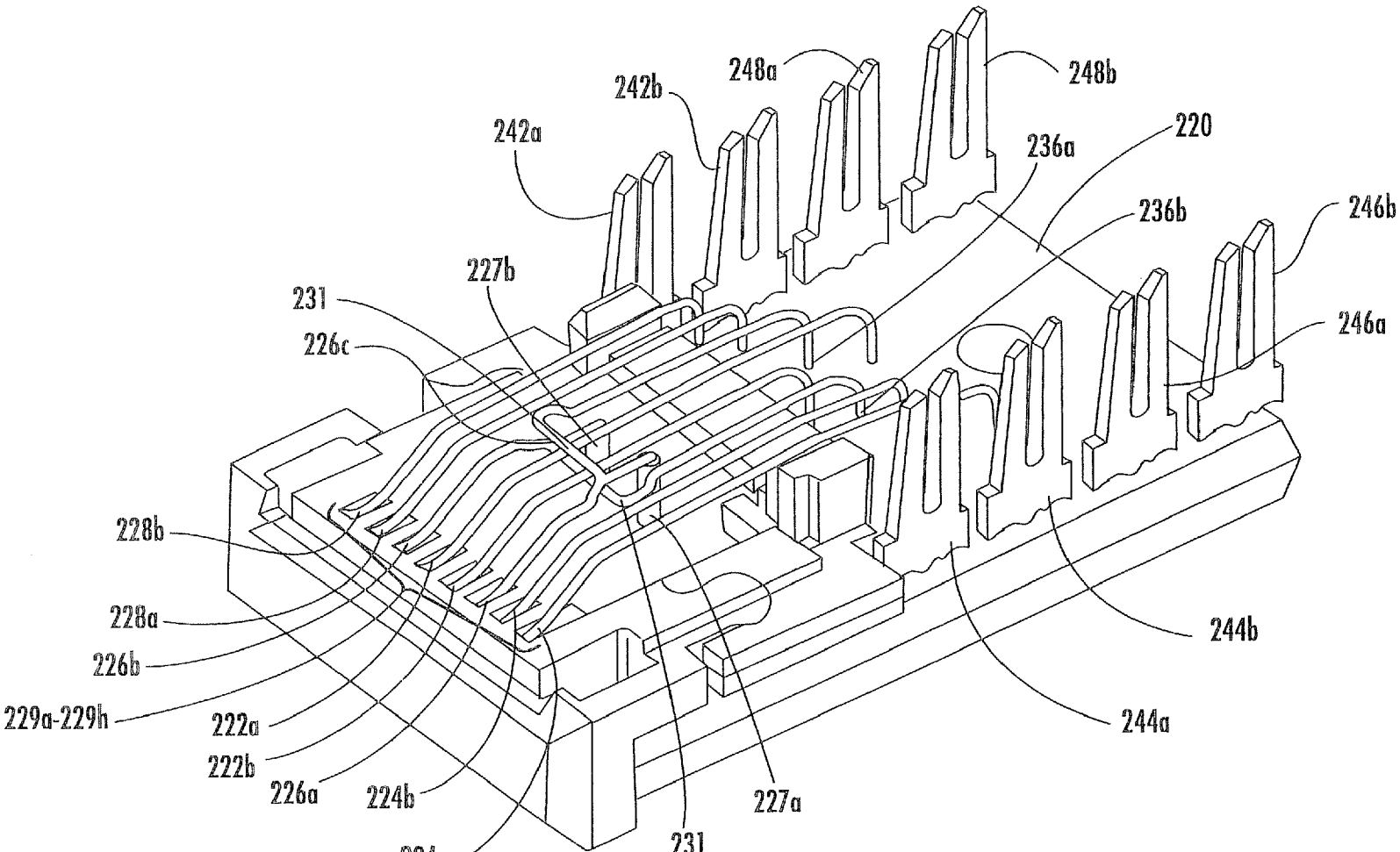
FIG. 7A is an enlarged perspective view of the communications jack of FIG. 7.
Figure 8A:
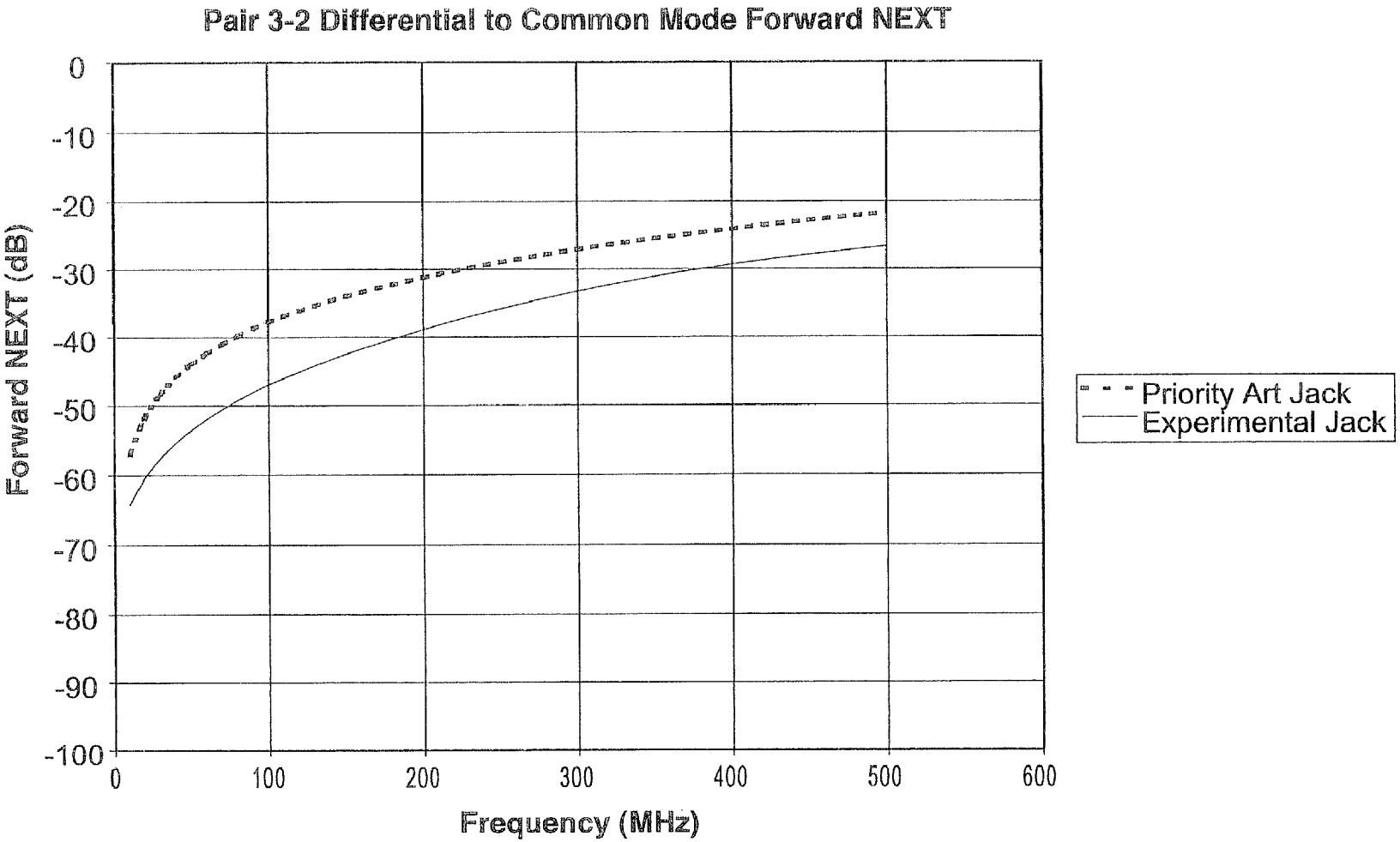
FIGS. 8A-8D are graphs plotting forward and reverse differential to common mode NEXT and FEXT as a function of frequency for pairs 3 and 2.
Figure 8B:
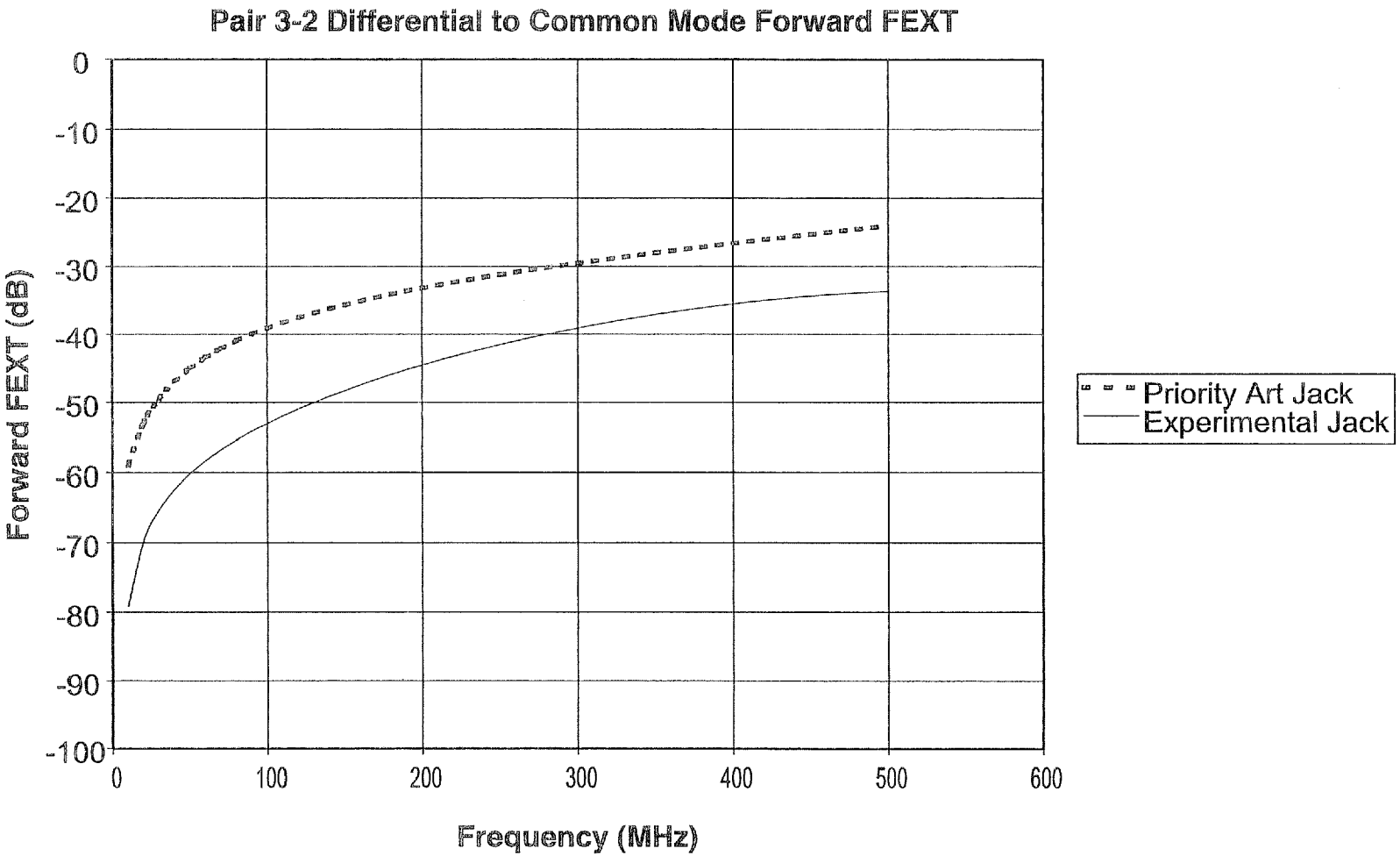
Figure 8C:
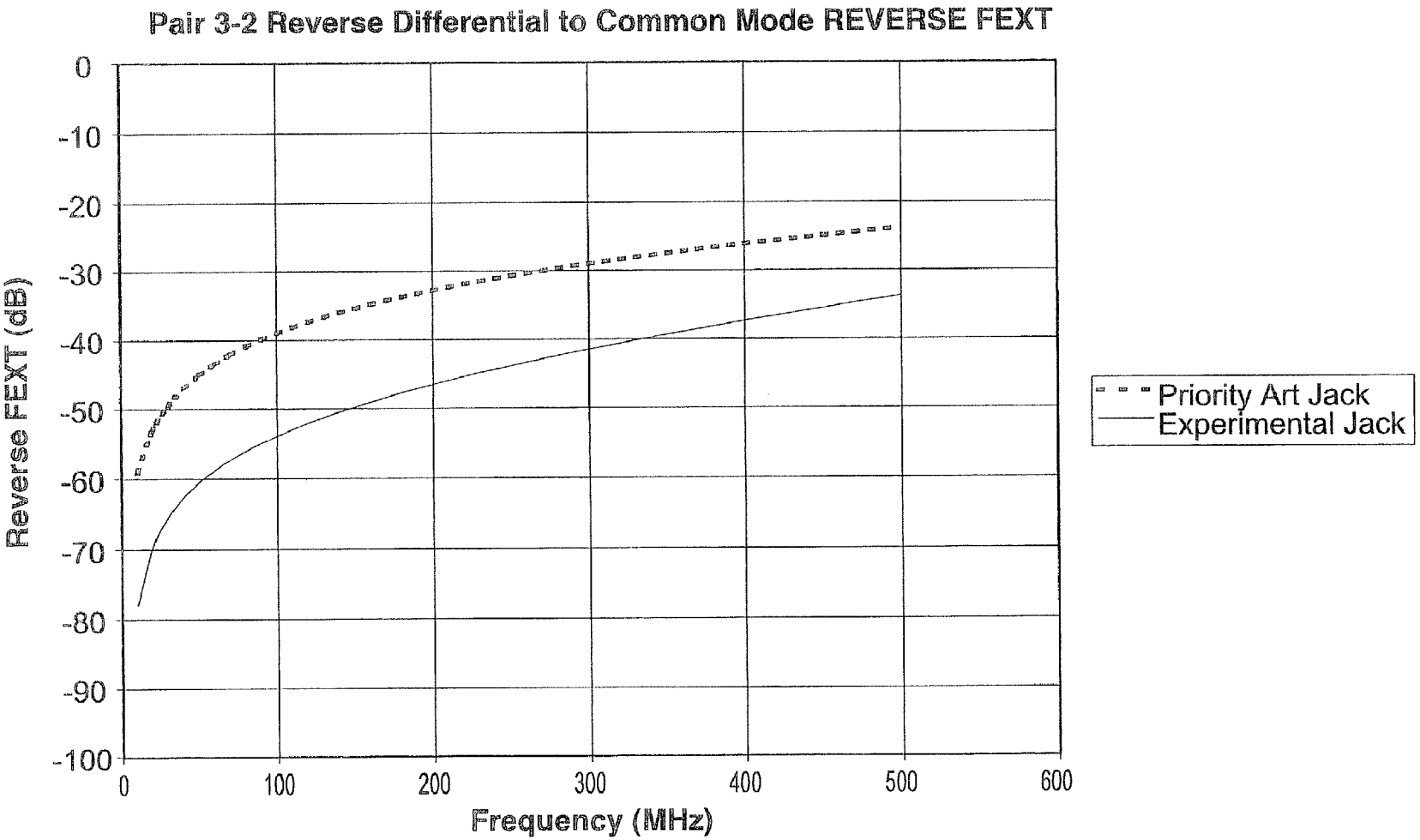
Figure 8D:
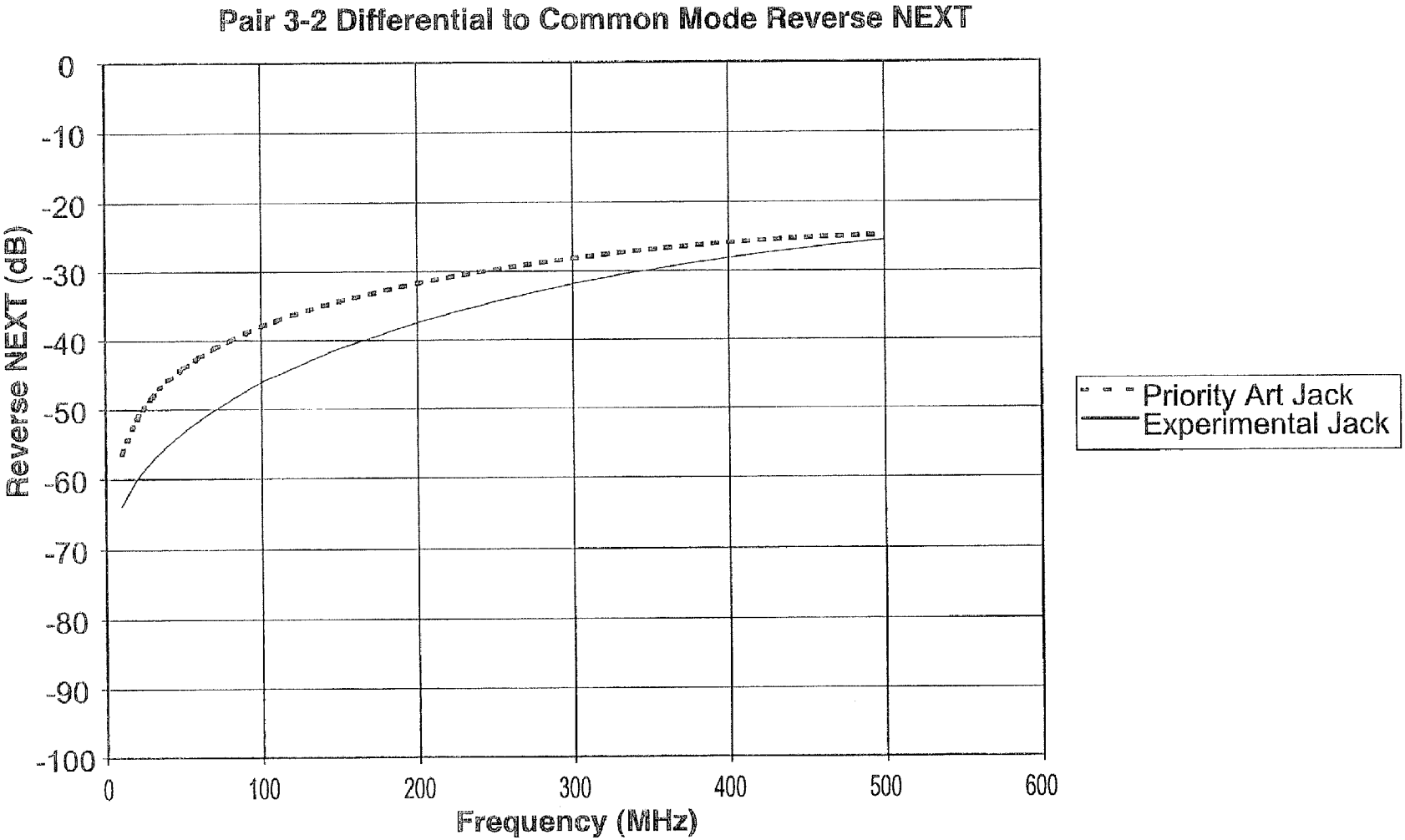
Figure 9A:
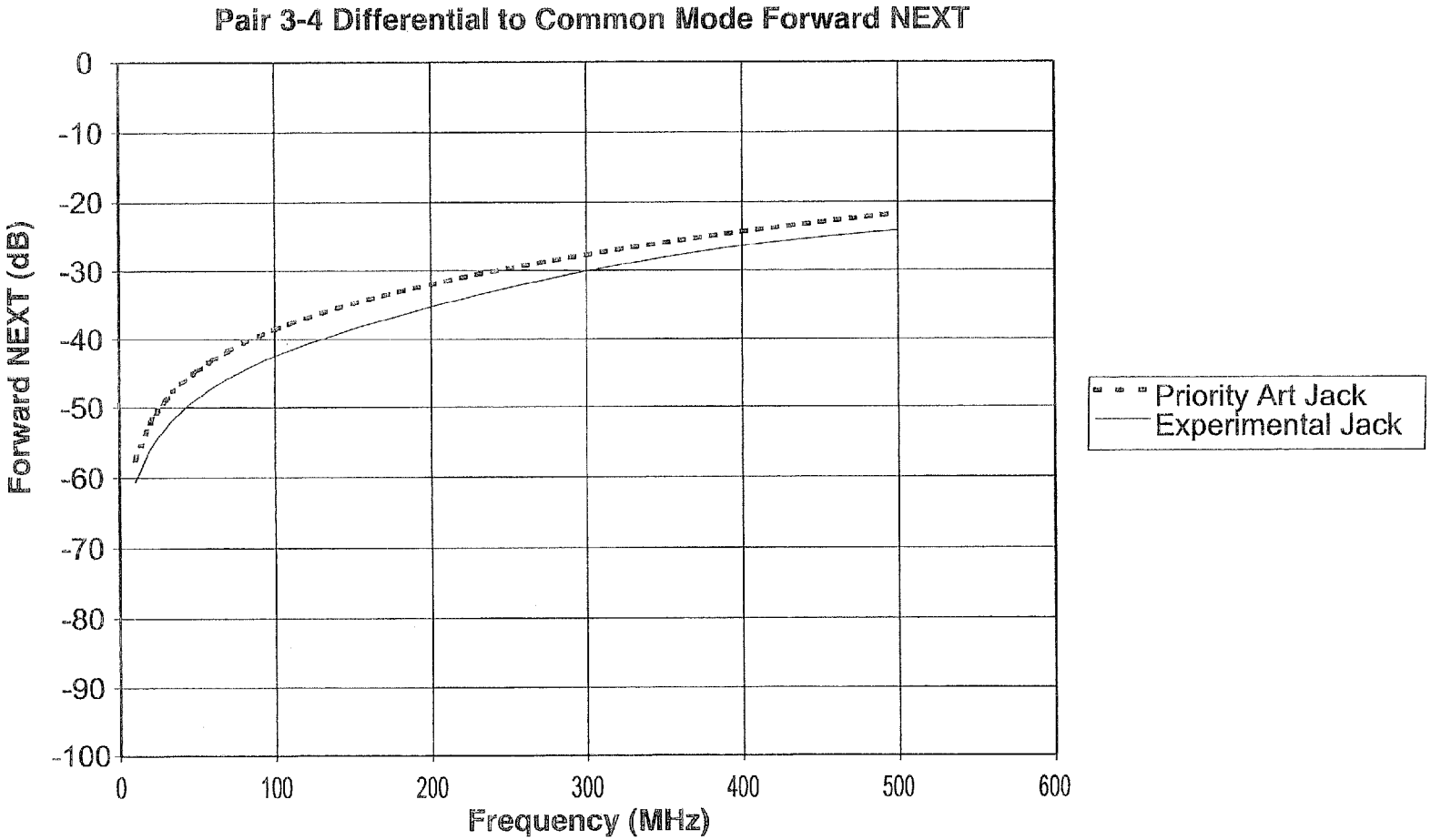
FIGS. 9A-9D are graphs plotting forward and reverse differential to common mode NEXT and FEXT as a function of frequency for pairs 3 and 4.
Figure 9B:
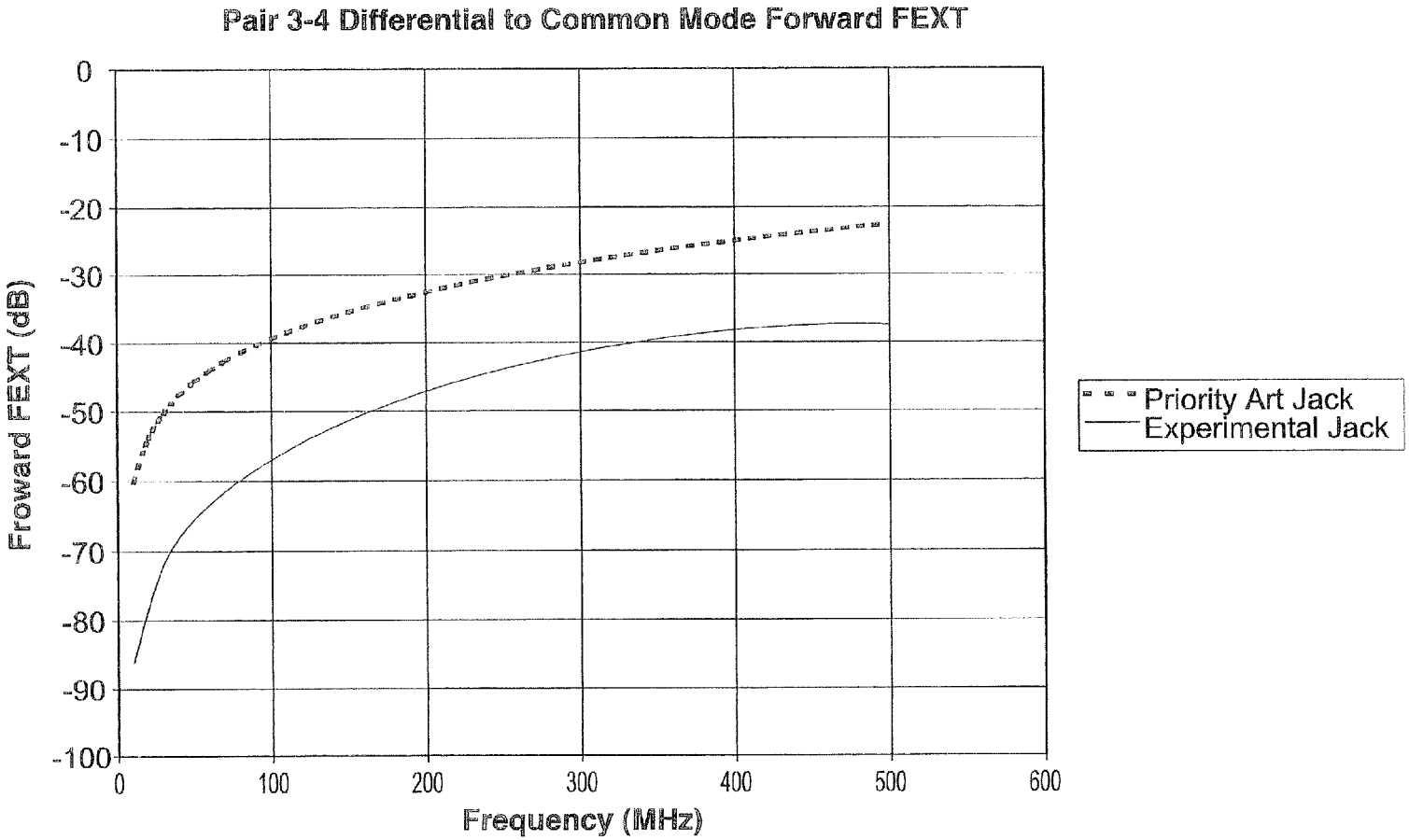
Figure 9C:
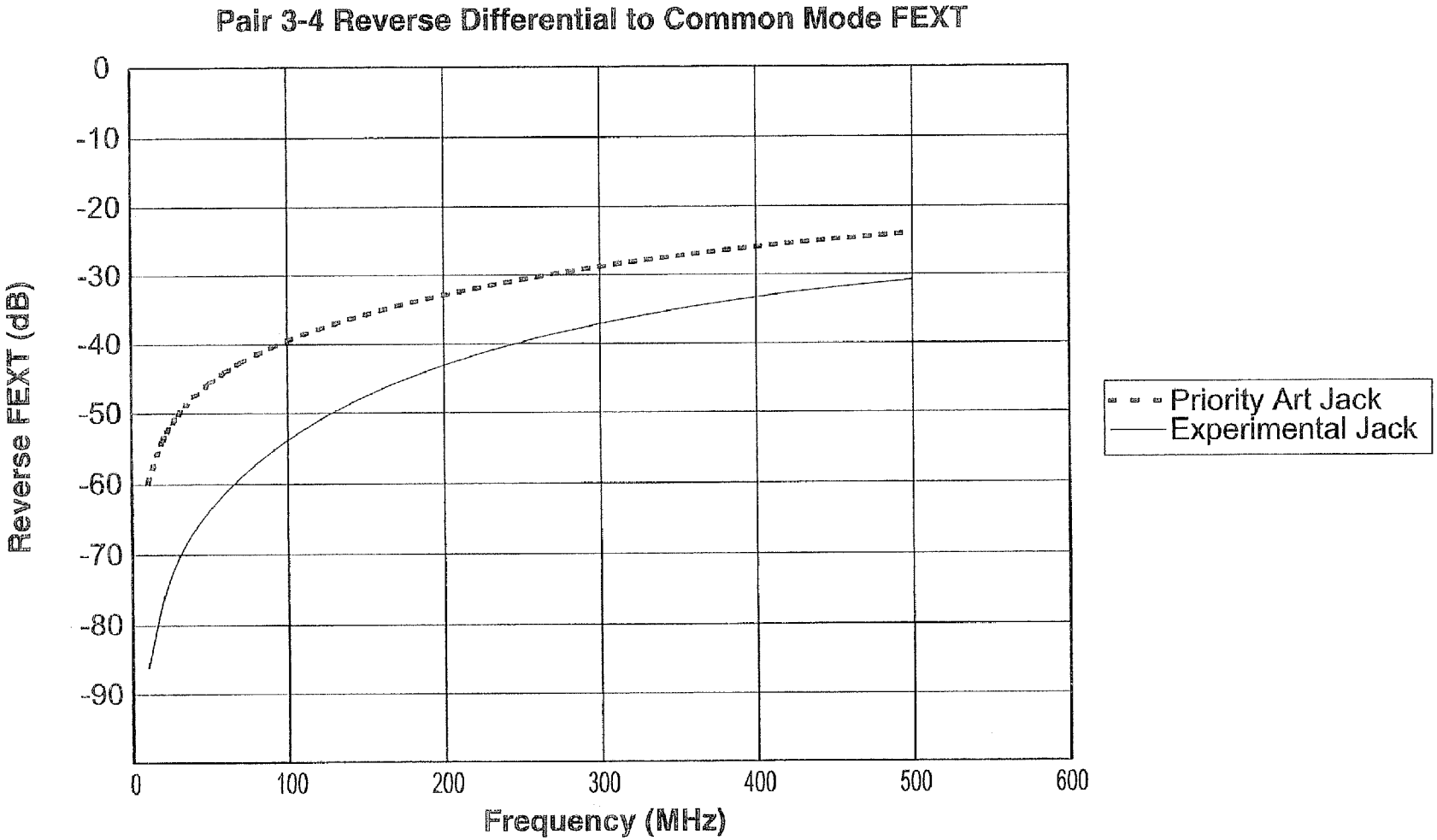
Figure 9D:
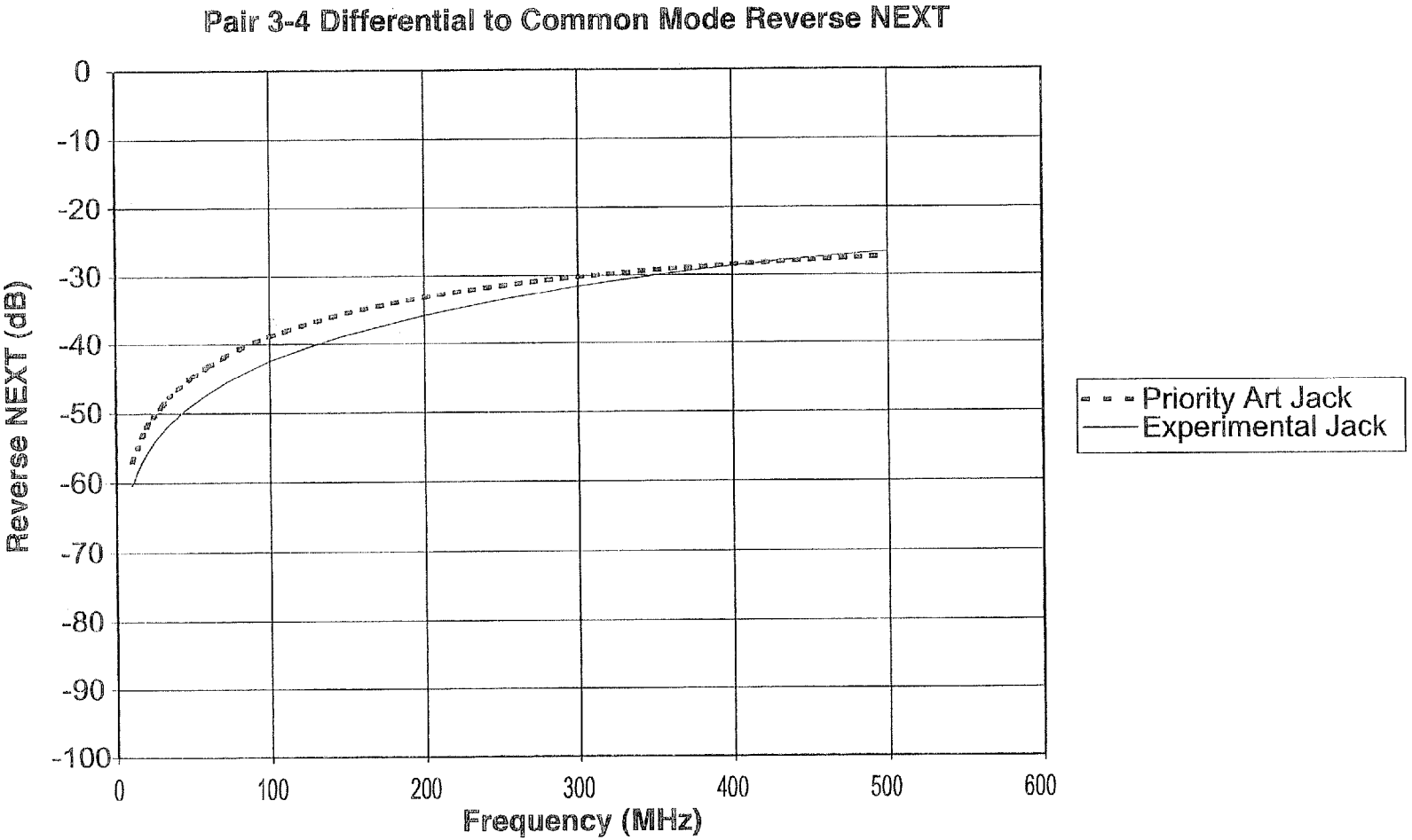

Those skilled in this art will recognize that various modifications may be made to the communications jack of FIGS. 10-13 such as, for example, the modifications discussed above that could be made to the communications jack of FIGS. 5-7, and that such modifications are within the scope of the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications jack, comprising:

a housing having a plug aperture;

a wiring board;

a first contact wire and a second contact wire that form a first differential pair of contact wires, the first and second contact wires each having a fixed end portion that is mounted in the wiring board and a deflectable portion that is at least partially positioned in the plug aperture; and a third contact wire and a fourth contact wire that form a second differential pair of contact wires, the third and fourth contact wires each having a fixed end portion that is mounted in the wiring board and a deflectable portion that is at least partially positioned in the plug aperture;

wherein at least a portion of the first differential pair of contact wires is sandwiched in between the contact wires of the second differential pair of contact wires, wherein the fourth contact wire crosses under the deflectable portion of the first contact wire and the deflectable portion of the second contact wire;

wherein the fourth contact wire further crosses under the deflectable portion of the third contact wire and wherein the third contact wire further crosses over the deflectable portion of the fourth contact wire.

2. The communications jack of claim 1, wherein the portion of the third contact wire that crosses over the deflectable portions of the first and second contact wires comprises a crossover segment, wherein the third contact wire further includes a support finger, and wherein the crossover segment is between the fixed end portion of the third contact wire and the support finger.

3. The communications jack of claim 2, wherein the wiring board includes a support structure, and wherein the support finger is supported by the support structure.

4. A communications jack, comprising:

a housing having a plug aperture;

a wiring board;

a first contact wire and a second contact wire that form a first differential pair of contact wires, the first and second contact wires each comprising a wire segment that includes a fixed end mounted in the wiring board and a free end; and a third contact wire and a fourth contact wire that form a second differential pair of contact wires, the third and fourth contact wires each comprising a wire segment that includes a fixed end mounted in the wiring board and a free end, and a support finger that branches off of the wire segment between the fixed end and the free end;

wherein at least a portion of the first differential pair of contact wires is sandwiched between the second differential pair of contact wires;

wherein the support finger of the third contact wire connects to a first support structure and the support finger of the fourth contact wire connects to a second support structure; and wherein the first and second support structures connect to the wiring board or the housing.

5. The communications jack of claim 4, wherein the second differential pair of contact wires includes a crossover, the crossover being in a deflectable portion of the contact wires.

6. The communications jack of claim 4, further comprising a third differential pair of contact wires and a fourth differential pair of contact wires, wherein only the second differential pair of contact wires includes a crossover.

7. The communications jack of claim 4, further comprising a stop that engages a distal end portion of the support finger of the third contact wire.

8. A communications jack, comprising:

a housing having a plug aperture;

a wiring board;

a first contact wire and a second contact wire that form a first differential pair of contact wires, the first and second contact wires each having a fixed end portion that is mounted in the wiring board and a free end portion;

a third contact wire and a fourth contact wire that form a second differential pair of contact wires, the third and fourth contact wires each having a fixed end portion that is mounted in the wiring board, a free end portion, an intermediate segment connecting the fixed end portion and the free end portion and a support finger branching off of the intermediate segment, the support finger including a base end that connects to the intermediate segment and a distal end opposite the base end;

wherein at least a portion of the first differential pair of contact wires is sandwiched in between the second differential pair of contact wires;

wherein the fourth contact wire crosses under the first contact wire and the second contact wire.

9. The communications jack of claim 8, wherein the third contact wire is configured so that the support finger and the free end portion of the third contact wire form a beam that absorbs substantially all of the strain experienced by the third contact wire in response to insertion of a mating plug into the plug aperture.

10. The communications jack of claim 9, wherein the distal end of the support finger of the third contact wire is not fixedly mounted.

11. The communications jack of claim 10, further comprising a stop that engages the distal end of the support finger of the third contact wire when a mating plug is inserted into the plug aperture.

12. The communications jack of claim 11, further comprising a second stop that engages the free end of the third contact wire when a mating plug is removed from the plug aperture.

13. A communications jack, comprising:

a housing having a plug aperture;

a first contact wire and a second contact wire that form a first differential pair of contact wires, the first and second contact wires each including a first end, a second end and an intermediate portion connecting the first end and the second end;

a third contact wire and a fourth contact wire that form a second differential pair of contact wires, wherein at least a portion of the second differential pair of contact wires is sandwiched between the first differential pair of contact wires;

a first conductive element branching off of the intermediate portion of the first contact wire, wherein the first conductive element crosses over the third contact wire and the fourth contact wire; and wherein the jack has a wiring board and the first conductive element comprising a signal carrying path from the first contact wire onto the wiring board, and wherein the second conductive element comprises a signal carrying path from the second contact wire onto the wiring board.

14. The communications jack of claim 13, wherein the first ends and the second ends of the first and second contact wires are free-floating.

15. The communications jack of claim 13, further comprising a first stop that engages the first end of the first contact wire and a second stop that engages the first end of the second contact wire when a mating plug is inserted into the plug aperture and then removed.

16. The communications jack of claim 15, further comprising a third stop that engages the second end of the first contact wire and a fourth stop that engages the second end of the second contact wire when a mating plug is inserted into the plug aperture.

17. The communications jack of claim 13, wherein the first conductive element comprises a fixed end portion of the first contact wire, wherein the first end of the first contact wire comprises a distal end of a support finger of the first contact, wherein the second conductive element comprises a fixed end portion of the second contact wire, and wherein the first end of the second contact wire comprises a distal end of a support finger of the second contact.

18. A communications jack, comprising:

a housing;

a wiring board positioned at least partially within the housing;

a first contact wire, a second contact wire, a third contact wire and a fourth contact wire mounted in the wiring board;

a first output terminal, a second output terminal, a third output terminal and a fourth output terminal mounted in the wiring board;

wherein the first contact wire and the second contact wire form a first differential pair of contact wires and the third contact wire and the fourth contact wire form a second differential pair of contact wires;

wherein at least a portion of the first contact wire is sandwiched in between the second and third contact wires, and at least a portion of the second contact wire is sandwiched in between the first and fourth contact wires;

wherein the wiring board includes a first conductive path that electrically connects the first contact wire to the first output terminal, a second conductive path that electrically connects the second contact wire to the second output terminal, a third conductive path that electrically connects the third contact wire to the third output terminal, a fourth conductive path that electrically connects the fourth contact wire to the fourth output terminal, wherein at least a portion of the third conductive path, is adjacent to the second conductive path;

wherein at least a portion of the fourth conductive path is adjacent to the first conductive path.

19. The communications jack of claim 18, wherein the first and second conductive paths do not form a crossover.

20. The communications jack of claim 18, wherein the at least a portion of the third conductive path is between the crossover and the third output terminal and the at least a portion of the fourth conductive path is between the crossover and the fourth output terminal.

* * * * *

UNITED STATES PATENT AND TRADEMARK OFFICE

CERTIFICATE OF CORRECTION

PATENT NO. : 7,320,624 B2
APPLICATION NO. : 11/688458
DATED : January 22, 2008
INVENTOR(S) : Hashim et al.

It is certified that error appears in the above-identified patent and that said Letters Patent is hereby corrected as shown below:

In the Claims:

Column 15, Claim 1, Lines 26-27: Please insert after "contact wires," and before "wherein the fourth contact"

The following paragraph -- wherein the third contact wire crosses over the deflectable portion of the first contact wire and the deflectable portion of the second contact wire; --

Column 16, Claim 8, Lines 28-29: Please insert after "the base end;" and before "wherein at least a portion"

The following paragraph -- wherein the support finger and the free end portion of the third contact wire are substantially aligned in a longitudinal direction and are not aligned with the fixed end portion of the third contact wire; --

Column 17, Claim 13, Lines 67-68: Please insert after "fourth contact wire; and" and before "wherein the jack"

The following paragraph -- a second conductive element branching off of the intermediate portion of the second contact wire, wherein the second conductive element crosses under the third contact wire and the fourth contact wire; --

Column 18, Claim 18, Lines 21-22: Please insert after "output terminal," and before "wherein at least a portion"

The following paragraph -- wherein the third conductive path and the fourth conductive path form a crossover; --

Signed and Sealed this

Fourth Day of November, 2008

JON W. DUDAS
*Director of the United States Patent and Trademark Office*